US008989626B2

(12) United States Patent
Satoh

(10) Patent No.: US 8,989,626 B2
(45) Date of Patent: Mar. 24, 2015

(54) IMAGE FORMING APPARATUS HAVING A MOVEMENT MECHANISM FOR REDUCING INTERFERENCE OF AN OPENING AND CLOSING MEMBER WITH A TRANSFER BODY

(75) Inventor: Atsushi Satoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 253 days.

(21) Appl. No.: 13/605,204

(22) Filed: Sep. 6, 2012

(65) Prior Publication Data

US 2013/0259526 A1 Oct. 3, 2013

(30) Foreign Application Priority Data

Mar. 27, 2012 (JP) ..... 2012-071899

(51) Int. Cl.
*G03G 15/08* (2006.01)
*G03G 21/16* (2006.01)

(52) U.S. Cl.
CPC ..... *G03G 21/1633* (2013.01); *G03G 21/168* (2013.01)
USPC ..... 399/121

(58) Field of Classification Search
CPC ..... G03G 15/0131; G03G 15/161; G03G 21/168; G03G 21/1633
USPC ..... 399/121, 124, 308, 313
See application file for complete search history.

(56) References Cited

U.S. PATENT DOCUMENTS

2006/0051125 A1* 3/2006 Nakayama ..... 399/110
2010/0232853 A1* 9/2010 Sasaki et al.
2010/0284722 A1* 11/2010 Kitayama
2011/0134455 A1* 6/2011 Nagashima et al.

FOREIGN PATENT DOCUMENTS

JP 2004-106988 A 4/2004
JP 2009-265353 A 11/2009

* cited by examiner

*Primary Examiner* — David Gray
*Assistant Examiner* — Laura Roth
(74) *Attorney, Agent, or Firm* — Sughrue Mion, PLLC

(57) ABSTRACT

An image forming apparatus having an apparatus body includes an image carrying body carrying an image, a transfer body which is provided in the apparatus body and to which the image is transferred, a first opening and closing member, a second opening and closing member, and a movement mechanism. The first opening and closing member is rotatable so as to open and close an opening of the apparatus body. The transfer body is detachable from the apparatus body through the opening. The second opening and closing member, which is displaceable relative to the first opening and closing member, together with the first opening and closing member opens and closes the opening in conjunction with opening and closing operations of the first opening and closing member. The movement mechanism causes the second opening and closing member to move in a direction away from the transfer body.

12 Claims, 22 Drawing Sheets

IMAGE FORMING APPARATUS HAVING A MOVEMENT MECHANISM FOR REDUCING INTERFERENCE OF AN OPENING AND CLOSING MEMBER WITH A TRANSFER BODY

CROSS-REFERENCE TO RELATED APPLICATIONS

This application is based on and claims priority under 35 USC 119 from Japanese Patent Application No. 2012-071899 filed Mar. 27, 2012.

BACKGROUND

1. Technical Field

The present invention relates to an image forming apparatus.

2. Summary

According to an aspect of the present invention, an image forming apparatus that forms an image on a recording medium and has an apparatus body includes an image carrying body which carries the image and is provided in the apparatus body having an upper portion and an opening, a transfer body which is provided in the apparatus body and to which the image carried by the image carrying body is transferred, a first opening and closing member, a second opening and closing member, and a movement mechanism. The first opening and closing member having a first rotational axis portion is attached to the upper portion of the apparatus body so as to be rotatable about the first rotational axis portion and rotates about the first rotational axis portion so as to open and close the opening, through which the transfer body is detachable from the apparatus body. The second opening and closing member is provided on the first rotational axis portion side of the first opening and closing member so as to be displaceable relative to the first opening and closing member, is located at a position at which, when the second opening and closing member is assumed not to be displaceable relative to the first opening and closing member and assumed to rotate together with the first opening and closing member about the first rotational axis portion, the second opening and closing member interferes with the transfer body. The second opening and closing member together with the first opening and closing member opens and closes the opening in conjunction with opening and closing operations of the first opening and closing member. The movement mechanism causes the second opening and closing member to move in a direction away from the transfer body in conjunction with the opening operation of the first opening and closing member.

BRIEF DESCRIPTION OF THE DRAWINGS

Exemplary embodiment of the present invention will be described in detail based on the following figures, wherein.

DETAILED DESCRIPTION

An example of an exemplary embodiment according to the present invention will be described below with reference to the drawings.

Figure 1:
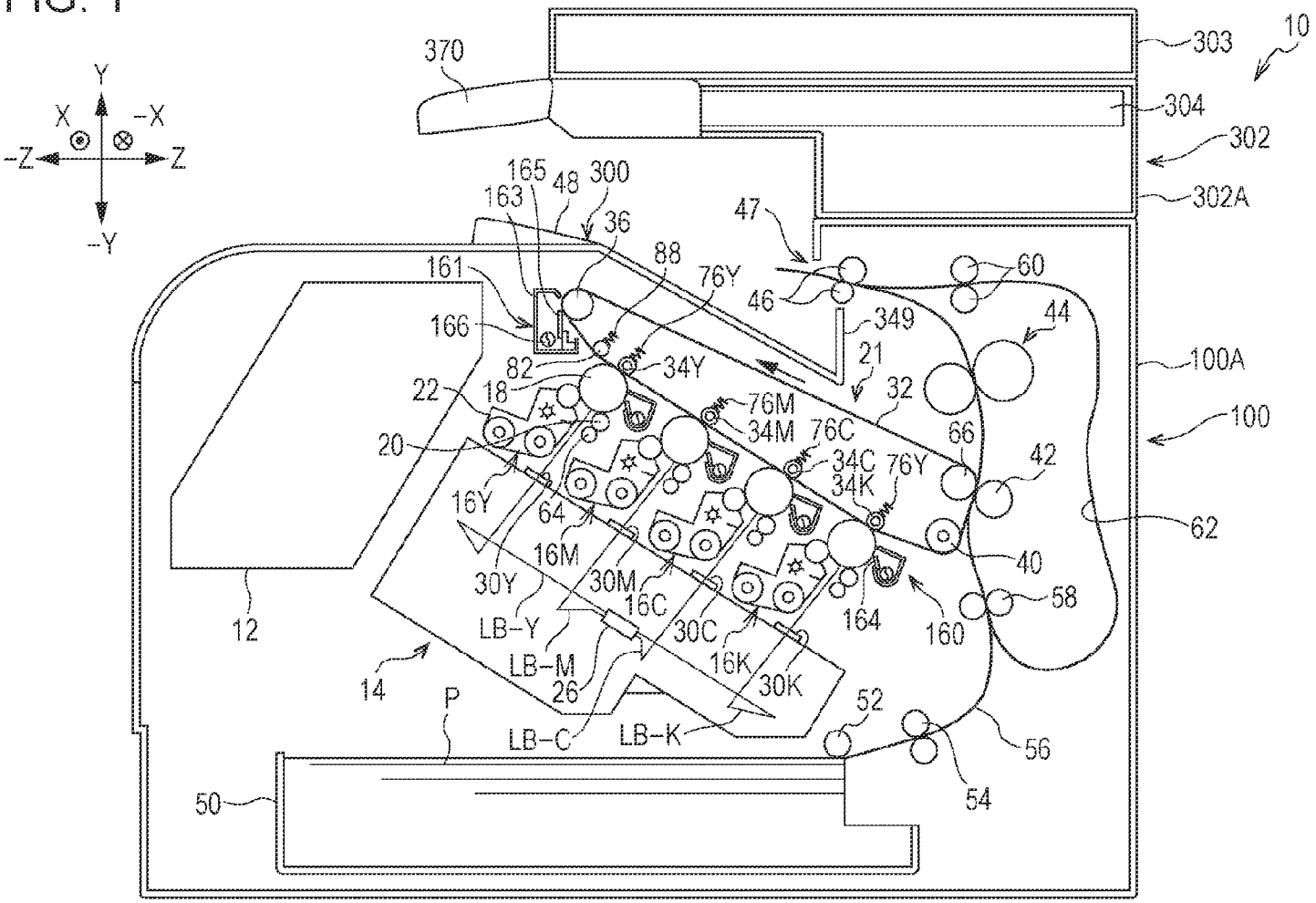
FIG. 1 is an outline view of the configuration of an image forming apparatus.
Figure 2:
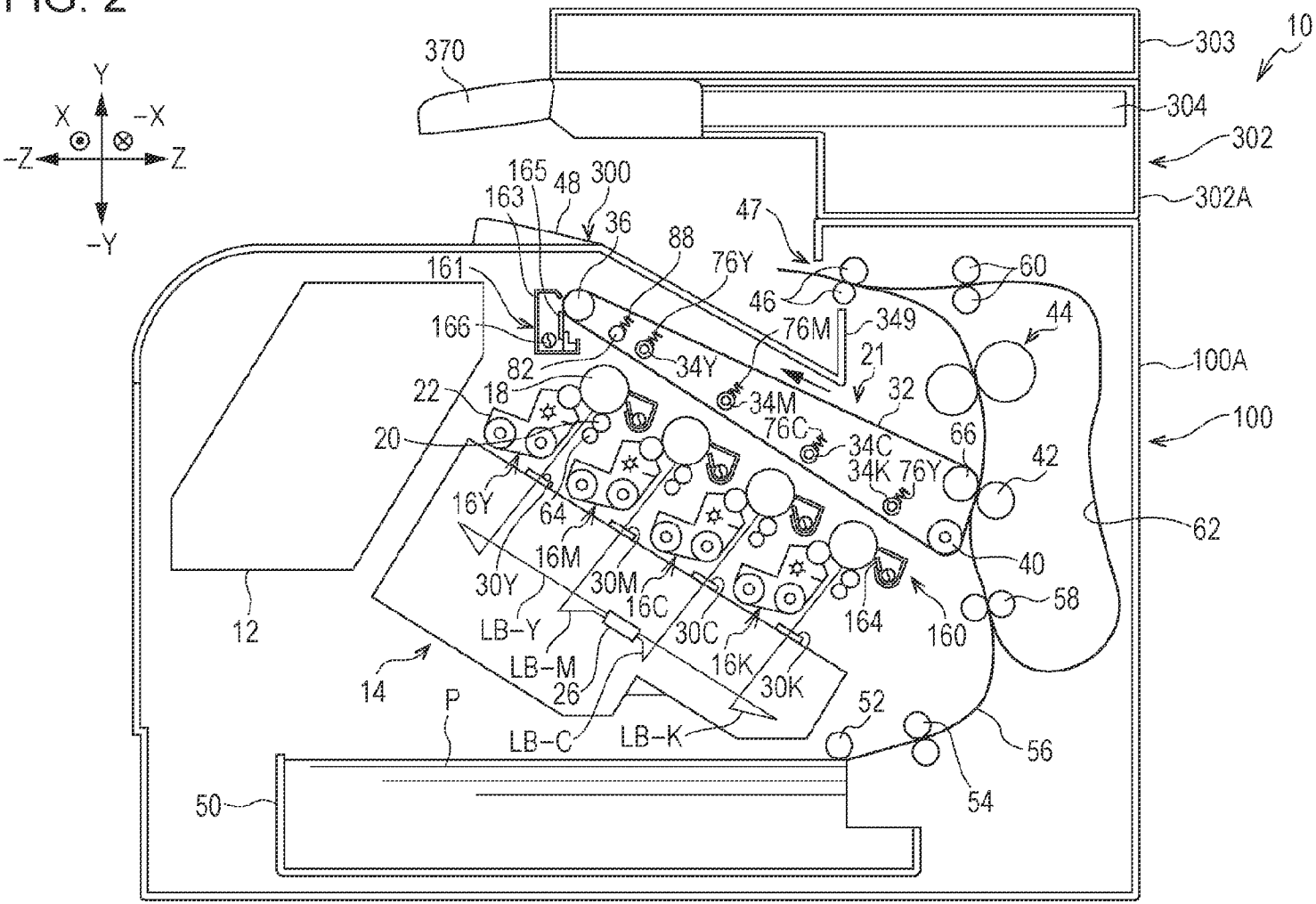
FIG. 2 is an outline view of the configuration of the image forming apparatus.

Configuration of Image Forming Apparatus According to Present Exemplary Embodiment A configuration of an image forming apparatus according to the present exemplary embodiment is initially described. FIGS. 1 and 2 are outline views illustrating the configuration of the image forming apparatus according to the present exemplary embodiment. X, −X, Y (upper), −Y (lower), Z, and −Z directions, which will be described later, are directions indicated by arrows in the drawings. In the drawing, a circle mark with an "x" thereinside indicates an arrow extending from the front side of the page to the back side of the page, and a circle mark with a dot thereinside indicates an arrow extending from the back side of the page to the front side of the page.

As illustrated in FIGS. 1 and 2, an image forming apparatus 10 includes an image reading device 302 and an image recording device 100. The image reading device 302 reads an image in a document and the image recording device 100 records the image on a recording medium P. The image recording device 100 allows the image to be recorded (formed) on the recording medium P in accordance with image data of an image of a document read by the image reading device 302 and image data obtained from devices external to the image forming apparatus 10. The image reading device 302 forms an upper portion of the image forming apparatus 10 and the image recording device 100 forms a lower portion of the image forming apparatus 10. The image forming apparatus 10 includes an image forming apparatus body 10A, which includes an image recording device body 100A of the image recording device 100 and an image reading device body 302A of the image reading device 302.

Image Reading Device 302

Figure 4:
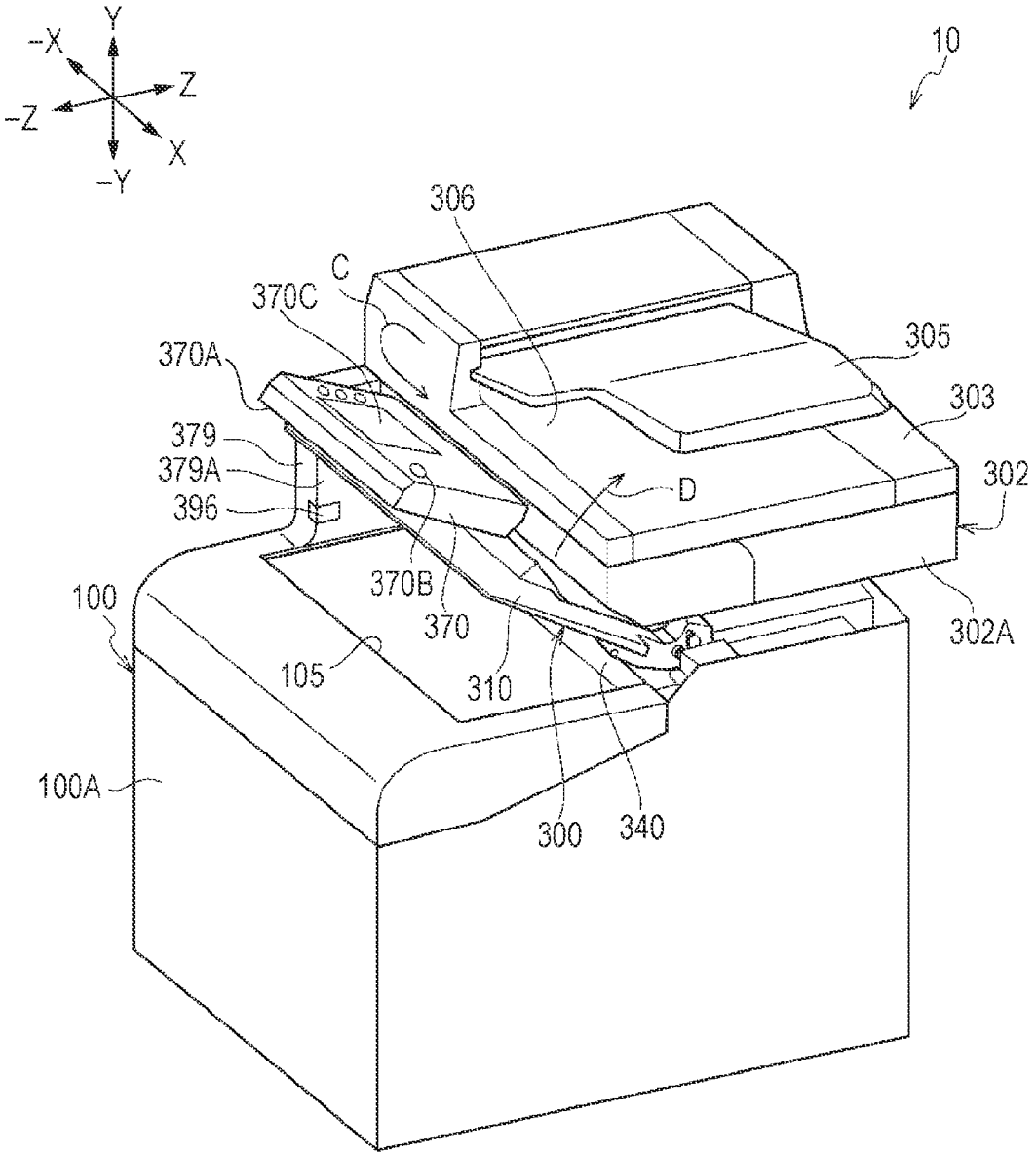
FIG. 4 is a perspective view of the configuration of the image forming apparatus.

As illustrated in FIGS. 1 and 4, the image reading device 302 includes a document transport device 303 and an image reading unit 304. The document transport device 303 is provided on an upper side of the document reading device body 302A and transports sheets of a document. The image reading unit 304 is provided in the document reading device body 302A and reads images in the sheets of the document transported by the document transport device 303.

The document transport device 303 has a document holding unit (document tray) 305 that receives plural sheets of the document. The sheets of the document received in the document holding unit (document tray) 305 are transported in a U-shaped path as indicated by an arrow C direction to a document output unit 306. The image reading unit 304 reads images in the sheets of the document transported in the U-shaped path.

An upper surface of the image reading device body 302A is formed of a transparent plate. The image reading unit 304 also reads images in a sheet of a document placed on the transparent plate. The document transport device 303 is attached to the image reading device body 302A such that the document transport device 303 is openable relative to the image reading device body 302A in an arrow D direction. The document transport device 303 serves as a pressure covering that presses the sheet of the document placed on the upper surface (transparent plate) of the image reading device body 302A. The image reading device body 302A is provided with an operation panel 370 with which an operator operates the image forming apparatus 10. The configuration of the operation panel 370 will be described later.

Image Recording Device 100

As illustrated in FIG. 1, the image recording device body 100A of the image recording device 100 includes an image processing unit 12 therein. The image processing unit 12 performs image processing on image data input thereto from the image reading device 302 and the external devices. The image processing unit 12 processes the received image data into gradation data of four colors, that is, yellow (Y), magenta (M), cyan (C), and black (K). An exposure device 14, which receives the processed gradation data and performs image exposure using laser beams LB, is provided in a central portion of the image recording device body 100A.

Four image forming units 16Y, 16M, 16C, and 16K, for yellow (Y), magenta (M), cyan (C), and black (K) are disposed on an upper side (on the Y direction side) of the exposure device 14 so as to be spaced apart from one another and inclined relative to the horizontal direction (in the −Z and Z directions). Notations Y, M, C, and K may be omitted in the case where identification by the notations Y, M, C, and K is not necessary in description.

These four image forming units 16Y, 16M, 16C, and 16K each have a similar configuration that includes an image carrying body 18, a charging member 20, a developing member 22, and an image carrying body cleaning device 160. The image carrying body 18 is rotatably disposed in the image recording device body 100A and carries an image. The charging member 20 charges an outer peripheral surface of the image carrying body 18. The developing member 22 develops an electrostatic latent image, which is formed on the outer peripheral surface of the image carrying body 18 having been charged through image exposure using the exposure device 14, with toner so as to visualize the electrostatic latent image as a toner image. The image carrying body cleaning device 160 removes residual toner remaining on the outer peripheral surface of the image carrying body 18 using a removing member 164.

The image carrying body 18 is rotated at a predetermined speed. The charging member 20, the developing member 22, and the image carrying body cleaning device 160 are arranged in this order in a direction in which the image carrying body 18 is rotated. A cleaning member 64 is provided on a lower side of the charging member 20. The cleaning member 64 is in contact with the charging member 20 so as to clean an outer peripheral surface of the charging member 20.

The exposure device 14 includes four semiconductor lasers (not shown), which are shared by the four image forming units 16Y, 16M, 16C, and 16K. The semiconductor lasers emit laser beams LB-Y, LB-M, LB-C, and LB-K in accordance with the gradation data.

A polygon mirror 26, which is a rotating polygon mirror, is radiated with the laser beams LB-Y, LB-M, LB-C, and LB-K emitted from the semiconductor lasers through cylindrical lenses (not shown). The polygon mirror 26 deflects and scans the laser beams LB-Y, LB-M, LB-C, and LB-K. The laser beams LB-Y, LB-M, LB-C, and LB-K having been deflected and scanned by the polygon mirror 26 scan exposure points on the respective image carrying bodies 18 from positions diagonally lower relative to the exposure points by way of imaging lenses (not shown), plural mirrors (not show), and respective glass windows 30Y, 30M, 30C, and 30K.

A first transfer unit 21, which is an example of a transfer device, is provided on an upper side (on the Y direction side) of the image forming units 16Y, 16M, 16C, and 16K. The first transfer unit 21 includes an intermediate transfer belt 32, a drive roller 36, a tension applying roller 40, a driven roller 66, and first transfer rollers 34Y, 34M, 34C, and 34K. The intermediate transfer belt 32 is an example of a transfer body onto which images carried by the image carrying bodies 18 are transferred. The drive roller 36 drives the intermediate transfer belt 32, which is stretched over the drive roller 36, so as to rotate the intermediate transfer belt 32 in a direction indicated by an arrow (counterclockwise direction in FIG. 1). The tension applying roller 40, which is an example of a tension applying member, applies tension to the intermediate transfer belt 32, which is stretched over the tension applying roller 40. The driven roller 66 is provided above the tension applying roller 40 and rotated by the intermediate transfer belt 32. The first transfer rollers 34Y, 34M, 34C, and 34K, which are examples of transfer members, are disposed on a side opposite to the image carrying bodies 18Y, 18M, 18C, and 18K with the intermediate transfer belt 32 disposed therebetween.

The intermediate transfer belt 32 is generally inclined relative to the image recording device body 100A. The driven roller 66 is disposed at a lower position compared to the drive roller 36.

The four first transfer rollers 34Y, 34M, 34C and 34K respectively transfer yellow (Y), magenta (M), cyan (C), and black (K) toner images formed on the image carrying bodies 18 of the image forming units 16Y, 16M, 16C, and 16K onto the intermediate transfer belt 32 such that the toner images are super posed on one another.

Furthermore, in the first transfer unit 21, an intermediate transfer belt cleaning device 161 is provided on a side opposite to the drive roller 36 with the intermediate transfer belt 32 therebetween. The intermediate transfer belt cleaning device 161 removes residual toner remaining on an outer peripheral surface of the intermediate transfer belt 32. The intermediate transfer belt cleaning device 161 includes a removing member 165 and a transport member 166. The removing member 165 is provided in a housing 163 and in contact with the intermediate transfer belt 32 so as to remove the residual toner remaining on the intermediate transfer belt 32. The transport member 166 is provided in the housing 163 and transports the residual toner removed by the removing member 165 to a toner containing unit (not shown). The specific configuration of the first transfer unit 21 will be described later.

A second transfer roller 42 is provided on a side opposite to the driven roller 66 with the intermediate transfer belt 32 therebetween. The yellow (Y), magenta (M), cyan (C), and black (K) toner images having been transferred onto the intermediate transfer belt 32 so as to be superposed on one another are transported by the intermediate transfer belt 32, pinched in a nip between the driven roller 66 and the second transfer roller 42, and then transferred onto the recording medium P, which is transported along a sheet transport path 56, through second transfer.

Furthermore, a fixing device 44 is provided on a downstream side of the second transfer roller 42 in a direction in which the recording medium P is transported (simply referred to as "downstream side" hereafter). The fixing device 44 fixes the toner images having been transferred onto the recording medium P to the recording medium P by applying heat and pressure.

Output rollers 46 are provided on the downstream side of the fixing device 44. The output rollers 46 eject the recording medium P, to which the toner images have been fixed, to an output unit 48 provided in an upper portion of the image recording device body 100A. The output unit 48 will be described later.

A sheet feeding member 50 is provided in a lower portion of the image recording device body 100A. The recording media P are stacked in the sheet feeding member 50. Furthermore, a sheet feeding roller 52 that feeds the recording media P stacked in the sheet feeding member 50 toward the sheet transport path 56 is provided, and a separation roller 54, which separates and transports the recording media P one sheet after another, is provided on the downstream side of the sheet feeding roller 52. A positioning roller 58, which adjusts transportation timing, is provided on the downstream side of the separation roller 54. With the above-described configuration, the recording medium P supplied from the sheet feeding member 50 is fed to a position (second transfer position), at which the intermediate transfer belt 32 and the second transfer roller 42 are in contact with each other, by the positioning roller 58 at a predetermined timing.

Furthermore, transportation rollers 60 are provided adjacent to the output rollers 46 (on the Z direction side). The transportation rollers 60 transport the recording medium P, to one side of which the toner images have been fixed by the fixing device 44, to a two-sided printing transportation path 62 instead of allowing the recording medium P to be directly ejected to the output unit 48 by the output rollers 46. By doing this, the recording medium P having been transported along the two-sided printing transportation path 62, the recording medium P being flipped, is transported again to the positioning roller 58. This time, toner images are transferred onto and fixed to the rear side of the recording medium P and the recording medium P is ejected to the output unit 48.

Image Recording Operation (Image Forming Operation) of Image Recording Device 100

Next, image recording operation (image forming operation) in which toner images are recorded (formed) on the recording medium P by the image recording device 100 according to the present exemplary embodiment is described.

Initially, gradation data for each color is sequentially output from the image processing unit 12 to the exposure device 14. The laser beams LB-Y, LB-M, LB-C, and LB-K emitted from the exposure device 14 in accordance with the gradation data scan the outer peripheral surface of the image carrying bodies 18 charged by the charging members 20 so as to form electrostatic latent images on the outer peripheral surface of the image carrying bodies 18. The developing members 22Y, 22M, 22C, and 22K respectively visualize the electrostatic latent images formed on the image carrying bodies 18 as yellow (Y), magenta (M), cyan (C), and black (K) toner images.

Furthermore, the yellow (Y), magenta (M), cyan (C), and black (K) toner images formed on the image carrying bodies 18 are transferred onto the rotating intermediate transfer belt 32 so as to be superposed on one another by the first transfer rollers 34Y, 34M, 34C, and 34K of the first transfer unit 21 disposed above the respective image forming units 16Y, 16M, 16C, and 16K.

The toner images in the respective colors having been transferred onto the rotating intermediate transfer belt 32 so as to be superposed on one another are transferred onto the recording medium P through second transfer using the second transfer roller 42. The recording medium P has been transported to the sheet transport path 56 at a predetermined timing from the sheet feeding member 50 using the sheet feeding roller 52, the separation roller 54, and the positioning roller 58.

The recording medium P, onto which the toner images have been transferred, is transported to the fixing device 44. The toner images having been transferred onto the recording medium P are fixed to the recording medium P by the fixing device 44. After that, the recording medium P is ejected to the output unit 48 disposed in the upper portion of the image recording device body 100A by the output roller 46.

In the case where images are formed on both sides of the recording medium P, the recording medium P, to one side of which the toner images have been fixed by the fixing device 44, is introduced to the two-sided printing transportation path 62 by the output roller 46 instead of being ejected to the output unit 48. The recording medium P is transported along the two-sided printing transportation path 62, thereby being flipped and transported again to the positioning roller 58. This time, toner images are transferred onto and fixed to the rear side of the recording medium P. After that, the recording medium P is ejected to the output unit 48 by the output rollers 46.

Specific Configuration of First Transfer Unit 21

Next, the specific configuration of the first transfer unit 21 is described.

Figure 3:
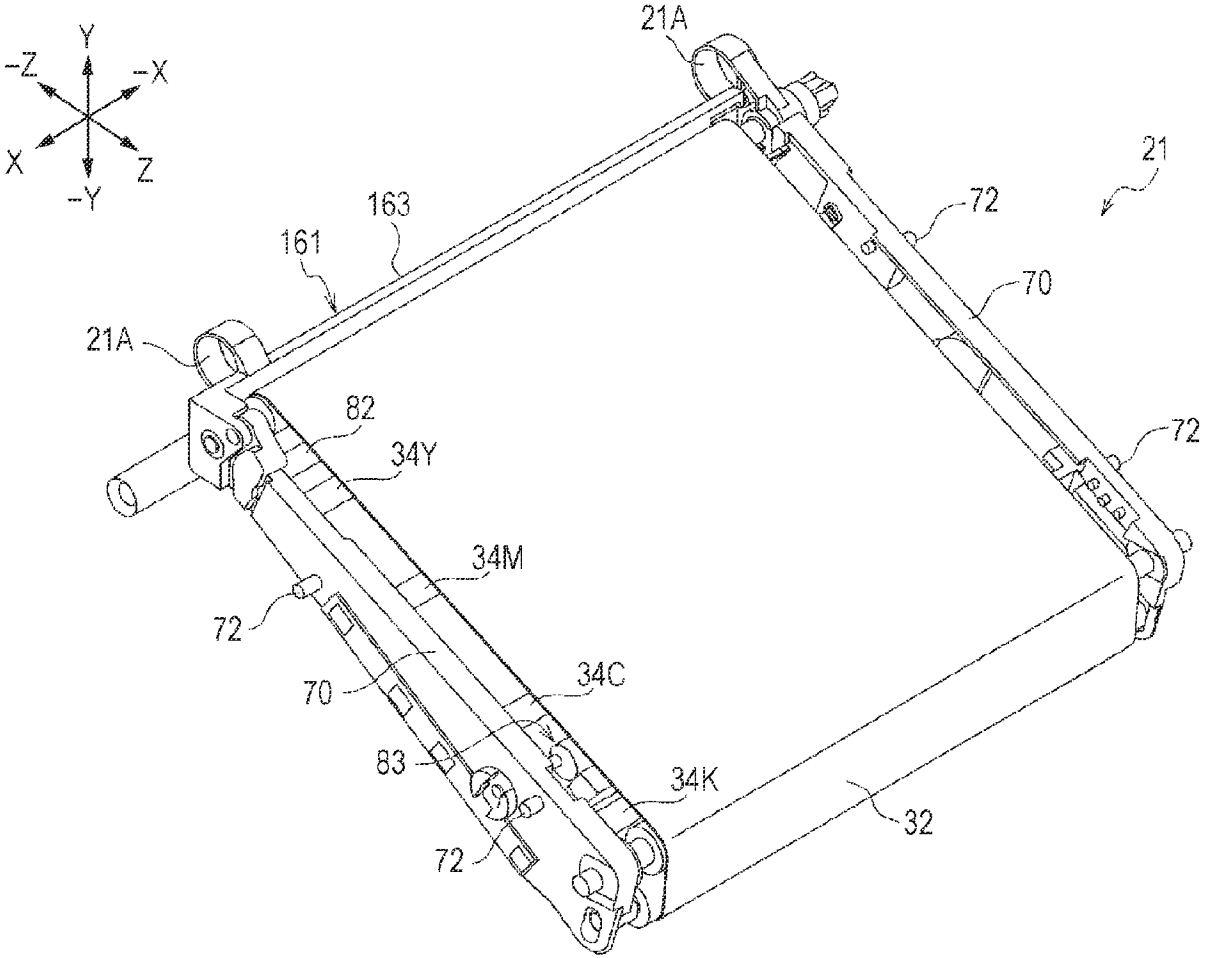
FIG. 3 is a perspective view of the configuration of the first transfer unit.

As illustrated in FIG. 3, the first transfer unit 21 includes a pair of frame members 70, which form the frame of the first transfer unit 21. The pair of frame members 70 are disposed on both sides of the first transfer rollers 34Y, 34M, 34C, and 34K with respect to rotation axis directions (X and −X directions) of the first transfer rollers 34Y, 34M, 34C, and 34K.

The pair of frame members 70 each have plural protrusions 72 formed on the outer surface thereof. The protrusions 72 are guided by guide grooves 104 (see FIG. 17), which will be described later, of the image recording device body 100A when the first transfer unit 21 is attached to or detached from the image recording device body 100A. The pair of frame members 70 also has grip portions 21A at ends thereof on the −Z direction side. The grip portions 21A are gripped by the operator when the first transfer unit 21 is attached to or detached from the image recording device body 100A.

The first transfer rollers 34Y, 34M, 34C, and 34K are supported by the pair of frame members 70 such that the first transfer rollers 34Y, 34M, 34C, and 34K are movable between contact positions and away positions. The first transfer rollers 34Y, 34M, 34C, and 34K are in contact with an inner peripheral surface of the intermediate transfer belt 32 at the contact positions (see FIG. 1) and spaced apart from the inner peripheral surface of the intermediate transfer belt 32 at the away positions (see FIG. 2).

As illustrated in FIGS. 1 and 2, coil springs 76Y, 76M, 76C, and 76K as examples of urging members are attached to the pair of frame members 70 so as to urge the first transfer rollers 34Y, 34M, 34C, and 34K toward the contact positions at which the first transfer rollers 34Y, 34M, 34C, and 34K are in contact with the inner peripheral surface of the intermediate transfer belt 32.

Furthermore, a regulating roller 82 is provided between the drive roller 36 and the first transfer roller 34Y serving as a regulating member. The regulating roller 82 supports the inner peripheral surface of the intermediate transfer belt 32 and regulates a rotating path of the intermediate transfer belt 32. The regulating roller 82 is supported by the pair of frame members 70 such that the regulating roller 82 is movable between a contact position and an away position. The regulating roller 82 is in contact with the inner peripheral surface of the intermediate transfer belt 32 at the contact position (see FIG. 1) and spaced apart from the inner peripheral surface of the intermediate transfer belt 32 at the away position (see FIG. 2).

A coil spring 88 is attached to the pair of frame members 70 as an example of the urging member, which urges the regulating roller 82 toward the contact position at which the regulating roller 82 is in contact with the inner peripheral surface of the intermediate transfer belt 32.

The pair of frame members 70 is provided with a movement structure 83 as illustrated in FIG. 3. The movement structure 83 moves the regulating roller 82 and the first transfer rollers 34Y, 34M, 34C, and 34K to the away positions against urging forces applied by the coil spring 88 and the coil springs 76Y, 76M, 76C, and 76K. At the away positions, the regulating roller 82 and the first transfer rollers 34Y, 34M, 34C, and 34K are spaced apart from the inner peripheral surface of the intermediate transfer belt 32.

In the present exemplary embodiment, moving the regulating roller 82 and the first transfer rollers 34Y, 34M, 34C, and 34K away from the intermediate transfer belt 32 causes the intermediate transfer belt 32 to move away from the image carrying bodies 18 (see FIG. 2); bringing the regulating roller 82 and the first transfer rollers 34Y, 34M, 34C, and 34K into contact with the intermediate transfer belt 32 causes the intermediate transfer belt 32 to be in contact with the image carrying bodies 18 (see FIG. 1).

Configuration for Detachment of First Transfer Unit 21 from Image Recording Device Body 100A As illustrated in FIG. 4, the image recording device body 100A has a detachment opening 105, which serves as an example of an opening, through which the first transfer unit 21 is detached from the image recording device body 100A. Part of the detachment opening 105 is superposed on the image reading device 302 (image reading device body 302A) in plan view (see FIG. 20), the image reading device 302 being disposed above the image recording device 100.

Figure 5:
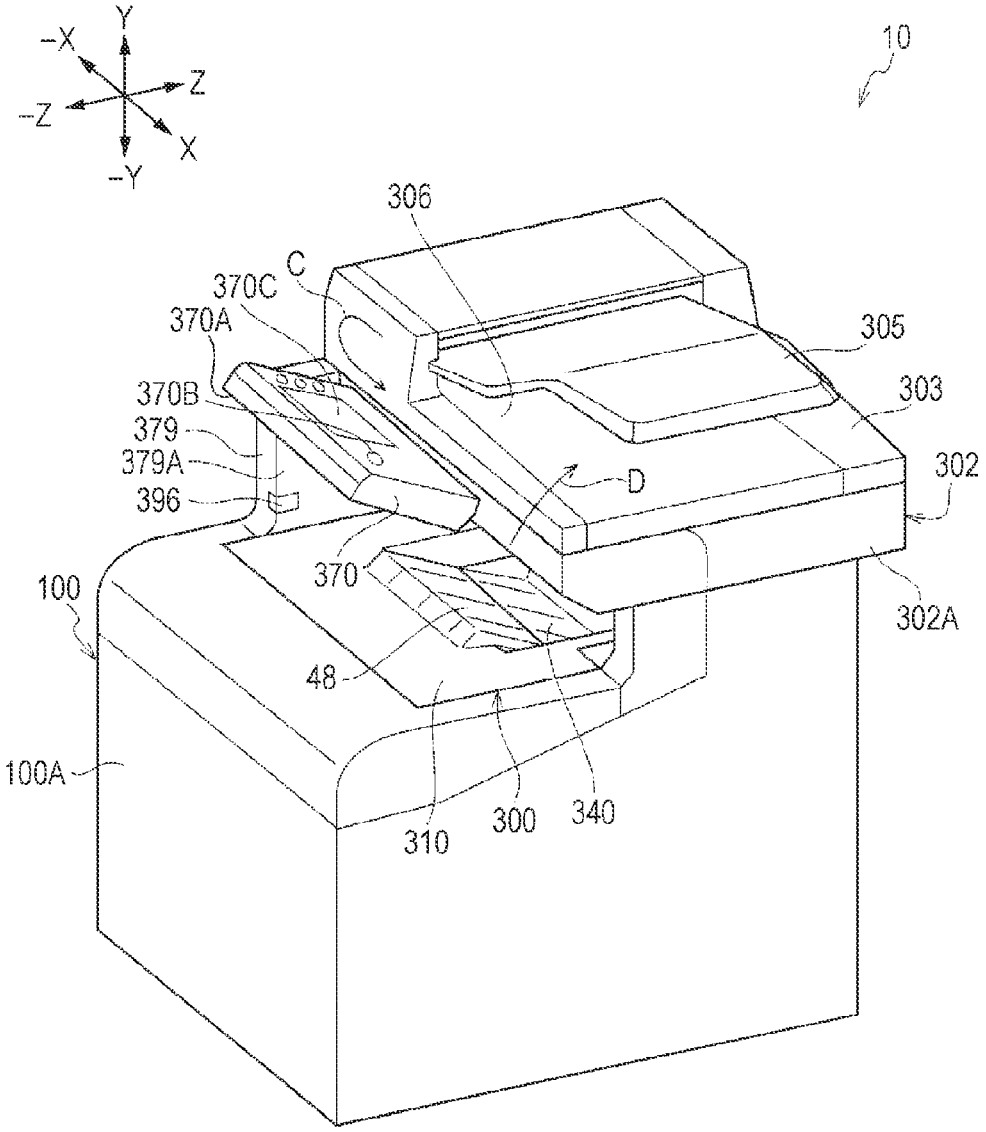
FIG. 5 is a perspective view of the configuration of the image forming apparatus.

As illustrated in FIGS. 4 and 5, a lid portion 300 is provided on an upper side of the image recording device body 100A. The lid portion 300 opens and closes the detachment opening 105 and, when the lid portion 300 closes the detachment opening 105, forms the output unit 48.

Figure 20:
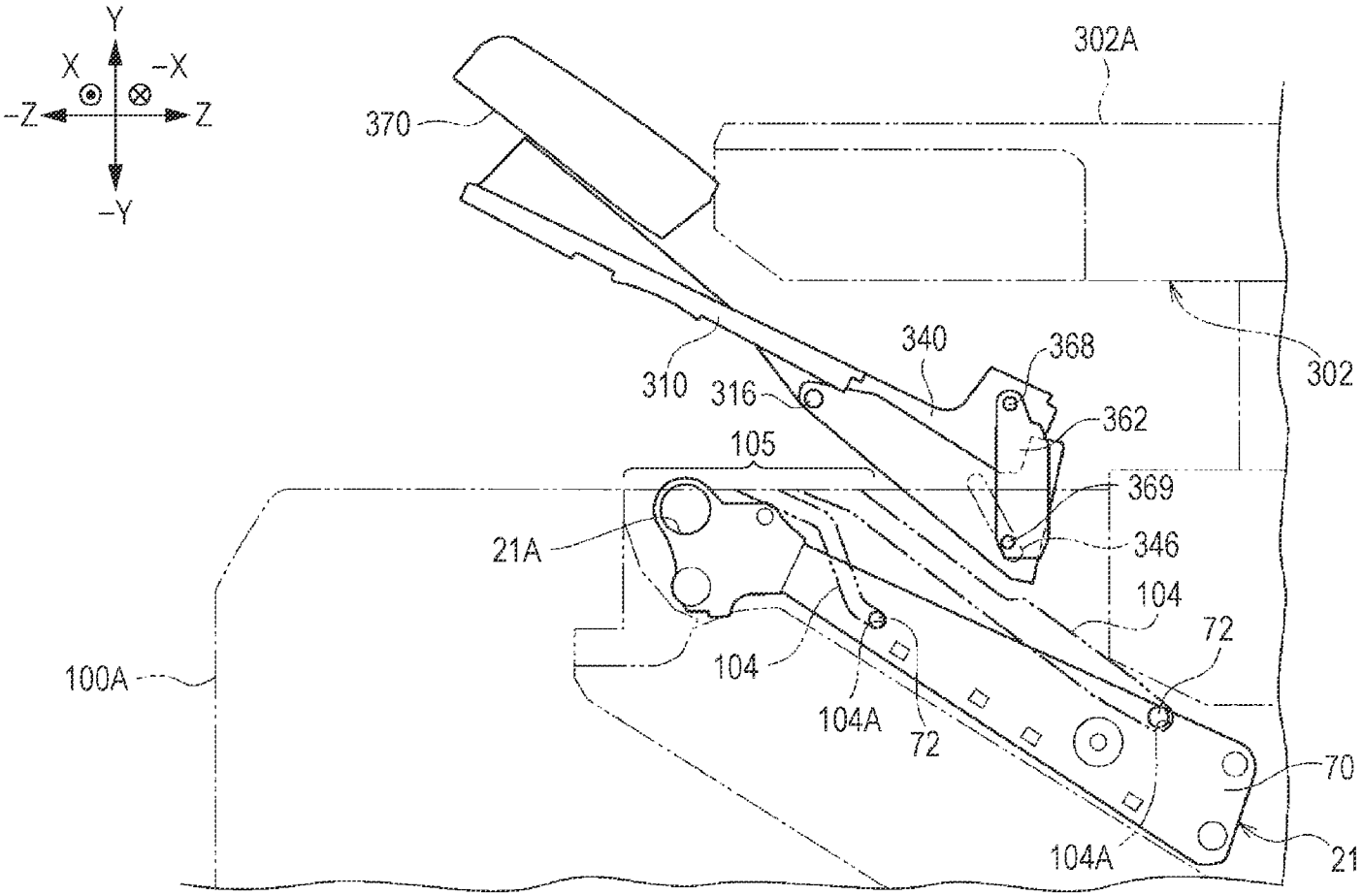
FIG. 20 is an operational view illustrating the operation in which the first transfer unit is detached.

As illustrated in FIG. 20, the image recording device body 100A also has the guide grooves 104. The guide grooves 104 guide the plural protrusions 72 (see FIG. 3) formed on the pair of frame members 70 of the first transfer unit 21 to the detachment opening 105 when the first transfer unit 21 is detached from the image recording device body 100A.

When the plural protrusions 72 formed on the pair of frame members 70 are supported at end portions 104A of the grooves 104, the first transfer unit 21 is supported by the image recording device body 100A such that the first transfer unit 21 is detachable through the detachment opening 105 in a perpendicular direction perpendicular to the rotation axis directions of the image carrying bodies 18 (in an inclined direction toward the upper left in FIG. 20). As will be described later, the first transfer unit 21 is attached to or detached from the image recording device body 100A with the lid portion 300 (top covering 310) opened.

Configuration of Lid Portion 300

Figure 6:
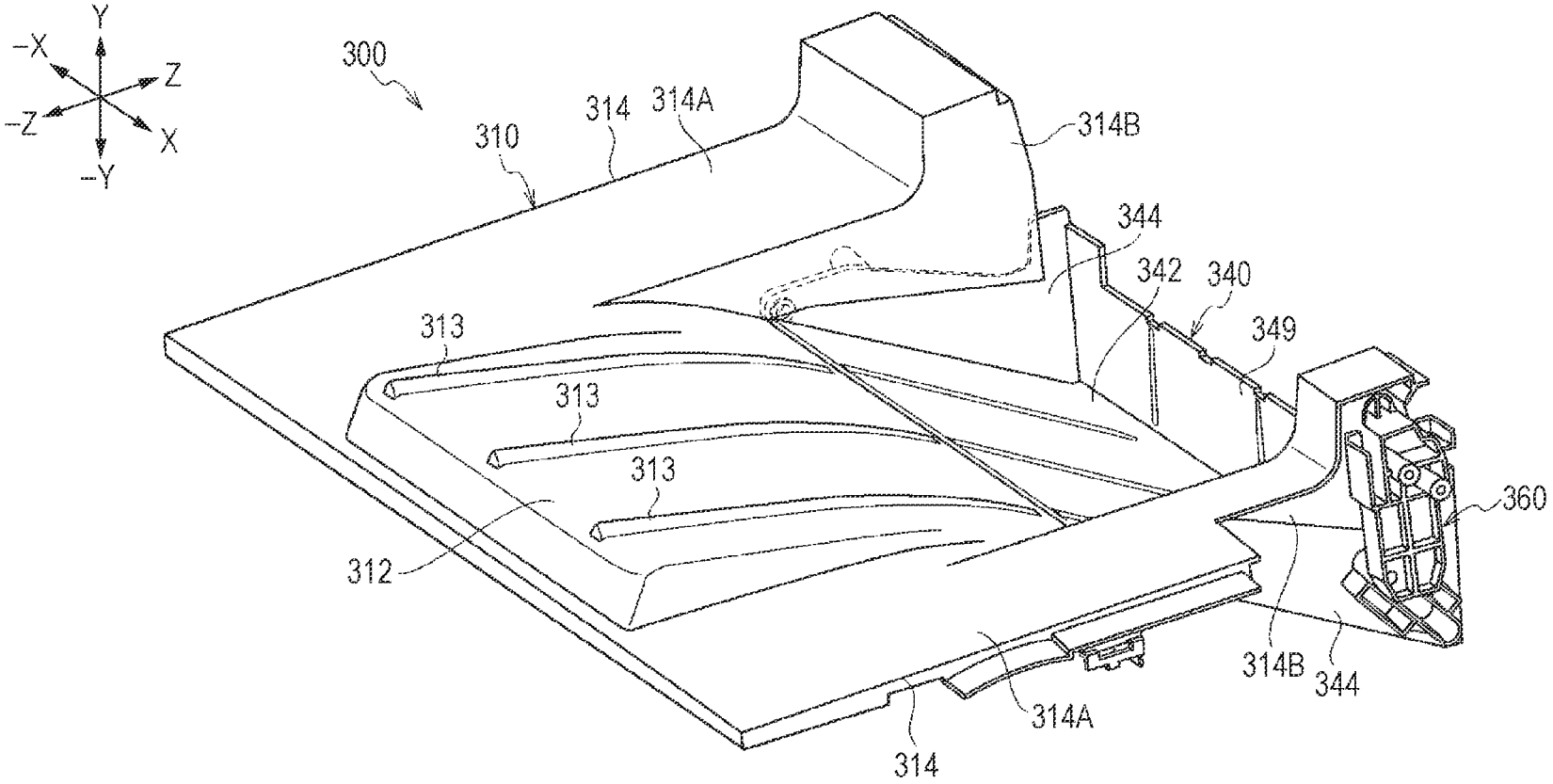
FIG. 6 is a perspective view of the configuration of a lid portion.

As illustrated in FIG. 6, the lid portion 300 includes a top covering 310, a bottom tray 340, and a movement mechanism 360. The top covering 310 is an example of a first opening and closing member that opens and closes the detachment opening 105. The bottom tray 340 is an example of a second opening and closing member that, together with the top covering 310, opens and closes the detachment opening 105 in conjunction with open and close operations of the top covering 310. The movement mechanism 360 moves the bottom tray 340 in a direction in which the bottom tray 340 moves away from the intermediate transfer belt 32 in conjunction with an opening operation of the top covering 310.

Top Covering 310

The top covering 310 has a receiving plate 312 on which the recording medium P is placed. The receiving plate 312 is formed on a side opposite to a side of a rotation shaft 368, which will be described later, in the top covering 310 and is gradually inclined downward as it extends in the Z direction. The receiving plate 312 has plural ribs 313 that extend in the Z direction in plan view.

A pair of arm portions 314 extend in the Z direction from both sides of the receiving plate 312 in the X direction (−X direction). The pair of arm portions 314 each have an upper plate 314A and a side plate 314B. The upper plates 314A each having a substantially rectangular shape extend in the Z direction and face upward. The side plates 314B extend downward (in the −Y direction) from side portions of the upper plates 314A on the Z direction side, and face side directions (X and −X directions).

Figure 7:
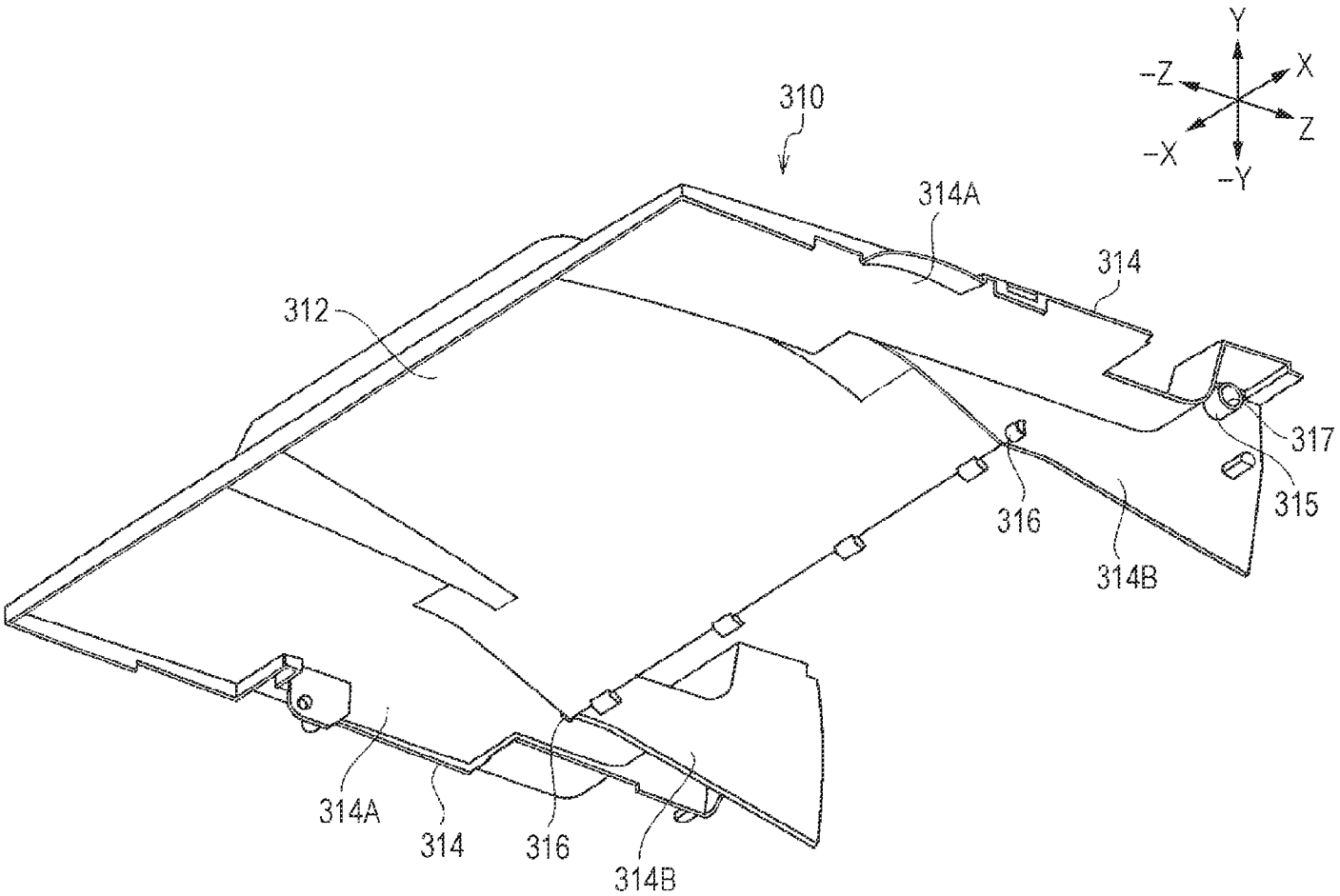
FIG. 7 is a perspective view of the configuration of a top covering.

As illustrated in FIG. 7, in which the top covering 310 is seen from a diagonally lower direction, a shaft portion 316 is formed in an intermediate portion in the Z direction of the top covering 310 on an outer surface of each of the pair of side plates 314B (surface of the side plate 314B on a side opposite to the receiving plate 312 side). The shaft portion 316 is inserted into a corresponding one of insertion holes 345 (second rotational axis portions) of the bottom tray 340, which will be described later.

Cylindrical portions 315 are formed at end sides on the Z direction side of the side plates 314B on the outer surfaces of the pair of side plate 314B. The cylindrical portions 315 (first rotational axis portions) each have an insertion hole 317, into which the rotation shaft 368 of a connection member 362, which will be described later, is inserted.

As illustrated in FIGS. 17 to 22, by inserting the rotation shafts 368 of the connection members 362 into the corresponding insertion holes 317 of the cylindrical portions 315 (see FIG. 7), the top covering 310 is attached to the image recording device body 100A such that the top covering 310 is rotatable about the rotation shafts 368. With this configuration, the top covering 310 is movable between an open position and a closed position. At the open position (position illustrated in FIGS. 20 to 22), at which the detachment opening 105 is opened, the end of the top covering 310 on the −Z direction side has been pulled upward so as to rotate the top covering 310 about the end of the top covering 310 on the Z direction side. At the closed position (position illustrated in FIGS. 17 and 18), at which the detachment opening 105 is closed, the end of the top covering 310 on the −Z direction side has been moved downward from the open position so as to rotate the top covering 310 about the end of the top covering 310 on the Z direction side.

Bottom Tray 340

As illustrated in FIG. 6, the bottom tray 340 is displaceable relative to the top covering 310 on the Z direction side of the top covering 310 (the rotation shaft 368 side). The bottom tray 340 is disposed at a position at which the bottom tray 340 is in contact with the intermediate transfer belt 32 when it is assumed that the bottom tray 340 is rotated together with the top covering 310 about the rotation shafts 368 of the top covering 310 instead of being displaced relative to the top covering 310 (see FIG. 17).

Figure 8:
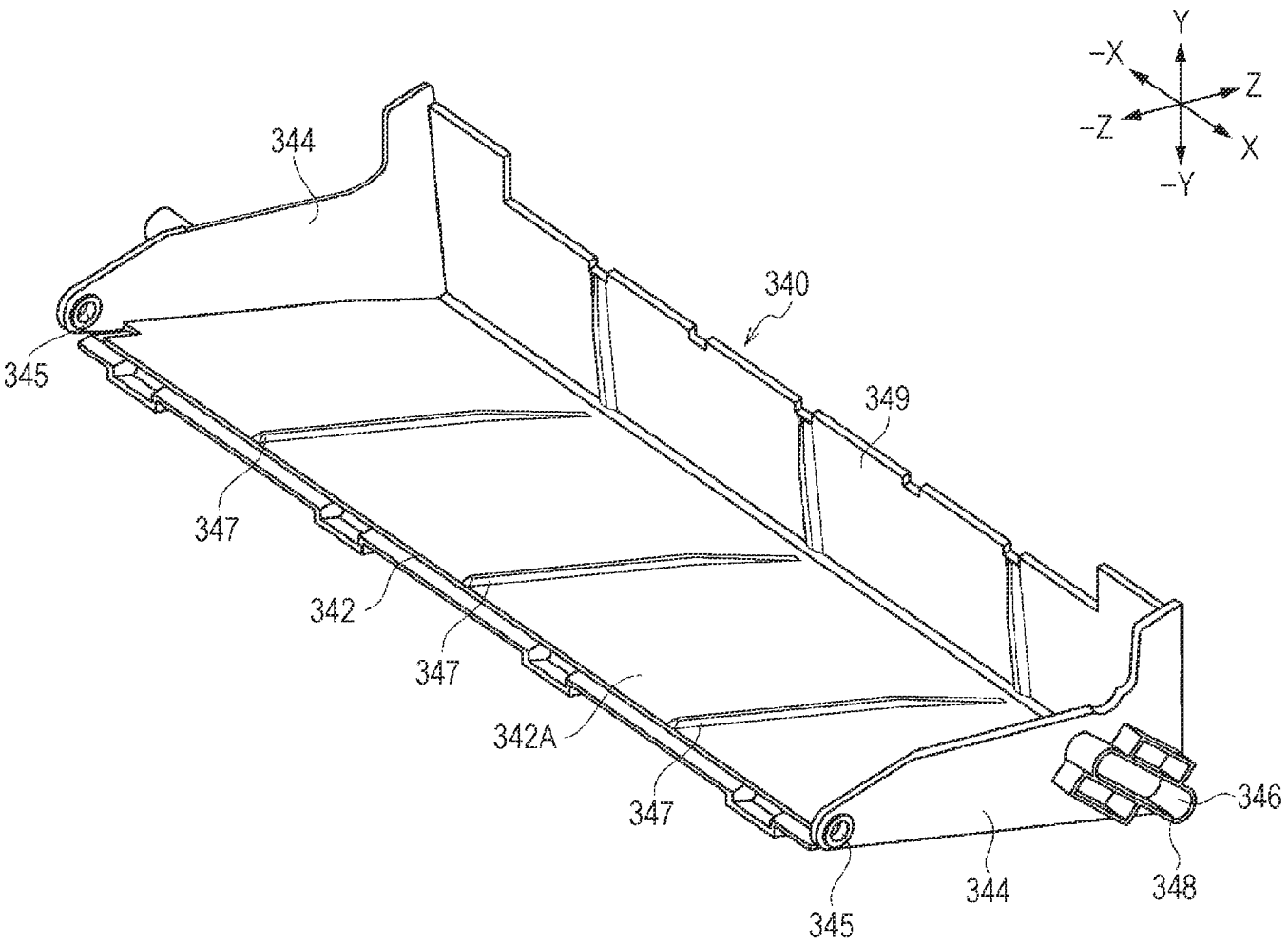
FIG. 8 is a perspective view of the configuration of a bottom tray.

As illustrated in FIG. 8, the bottom tray 340 has a receiving plate 342, on which the recording medium P is placed. The receiving plate 342 has an inclined surface 342A, which downwardly inclined toward the Z direction side (rotation shaft 368 side) when the top covering 310 closes the detachment opening 105. The inclined surface 342A has plural ribs 347 that extend in the Z direction. The receiving plate 342 of the bottom tray 340 is disposed at a position diagonally lower relative to the receiving plate 312 of the top covering 310. The receiving plate 342 of the bottom tray 340 together with the receiving plate 312 of the top covering 310 allows the recording medium P ejected from the image recording device body 100A to be placed thereon. That is, the bottom tray 340 together with part of the top covering 310 functions as an example of a receiving member, on which the recording medium P ejected from the image recording device body 100A is placed.

Substantially triangular side plates 344 are disposed on both sides in the X direction (−X direction) of the receiving plate 342 on the upper side of the receiving plate 342 so as to be integrated with the receiving plate 342. Insertion holes 345 are formed on ends on the −Z direction side of the pair of side plates 344, into which the respective shaft portions 316 of the top covering 310 are rotatably inserted. Thus, the bottom tray 340 is supported by the top covering 310 such that the bottom tray 340 is rotatable about the shaft portions 316. As described above, the insertion holes 345 are served as connection portions of the bottom tray 340 to be connected to the top covering 310.

Cylindrical portions 348 are formed on the ends on the Z direction side of outer surfaces of the pair of side plates 344 (surfaces each formed on a side of corresponding one of the side plates 344 opposite to a side on which the receiving plate 342 exists). The cylindrical portions 348 each have a diagonally upwardly extending long hole (an example of a guiding portion) 346 formed therein. Shaft portions 369 of the connection members 362, which will be described later, are inserted into the respective long holes 346 of the cylindrical portions 348.

A side plate 349 that faces the −Z direction side is formed between the pair of side plates 344 at the end on the Z direction side of the receiving plate 342. The side plate 349 is integrated with the receiving plate 342 and the pair of side plates 344. As illustrated in FIG. 1, the side plate 349 serves as a lower edge of an ejection opening 47, through which the recording medium P is ejected from the image recording device body 100A.

Movement Mechanism 360

Figure 9:
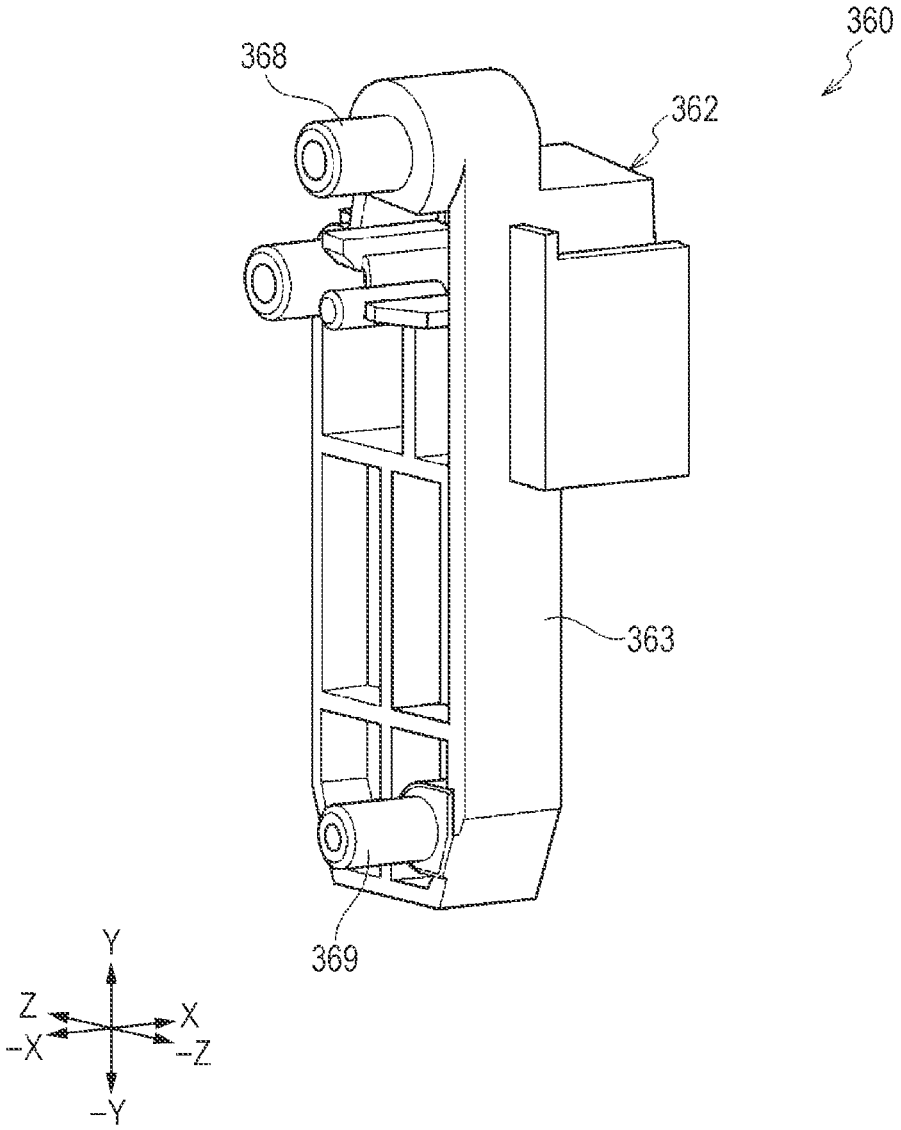
FIG. 9 is a perspective view of the configuration of a movement mechanism.

As illustrated in FIG. 9, the movement mechanism 360 has a pair of connection members 362, which connect the top covering 310 to the bottom tray 340. The pair of connection members 362 each have a substantially box-shaped body portion 363, which extends in the up-down direction. The body portions 363 are secured to the image recording device body 100A and disposed in the up-down direction so as to extend along the outer surfaces of the pair of side plates 314B of the top covering 310 and the outer surfaces of the pair of side plates 344 of the bottom tray 340 (see FIG. 6).

The rotation shafts 368 are formed on inner surfaces (surfaces on the top covering 310 side (surfaces on the X and −X direction sides)) in upper portions of the pair of body portions 363. The rotation shafts 368 are each inserted into the insertion hole 317 of a corresponding one of the cylindrical portions 315 of the top covering 310. With this configuration, as described above, the top covering 310 is rotatable about the rotation shafts 368. Thus, connection portions that connect the top covering 310 to the connection members 362 serves as a rotation center (rotation shafts 368) of the top covering 310.

The shaft portions (examples of the guided portions) 369 are formed on inner surfaces (surfaces on the bottom tray 340 side (surfaces on the X and −X direction sides)) in lower portions of the pair of body portions 363. The shaft portions 369 are each inserted into the long hole 346 of a corresponding one of the cylindrical portions 348 of the bottom tray 340. That is, the connection members 362 has the shaft portions (the examples of the guided portions) 369, which are guided by the long holes (guiding portions) 346 of the bottom tray 340, serve as connection portions that connect the connection members 362 to the bottom tray 340. Thus, the bottom tray 340, which is connected to the top covering 310 by the insertion holes 345, does not rotate together with the top covering 310. Instead, as the top covering 310 rotates, the insertion hole 345 side moves up, thereby moving up the cylindrical portions 348 (long holes 346) (see FIG. 19).

Figure 21:
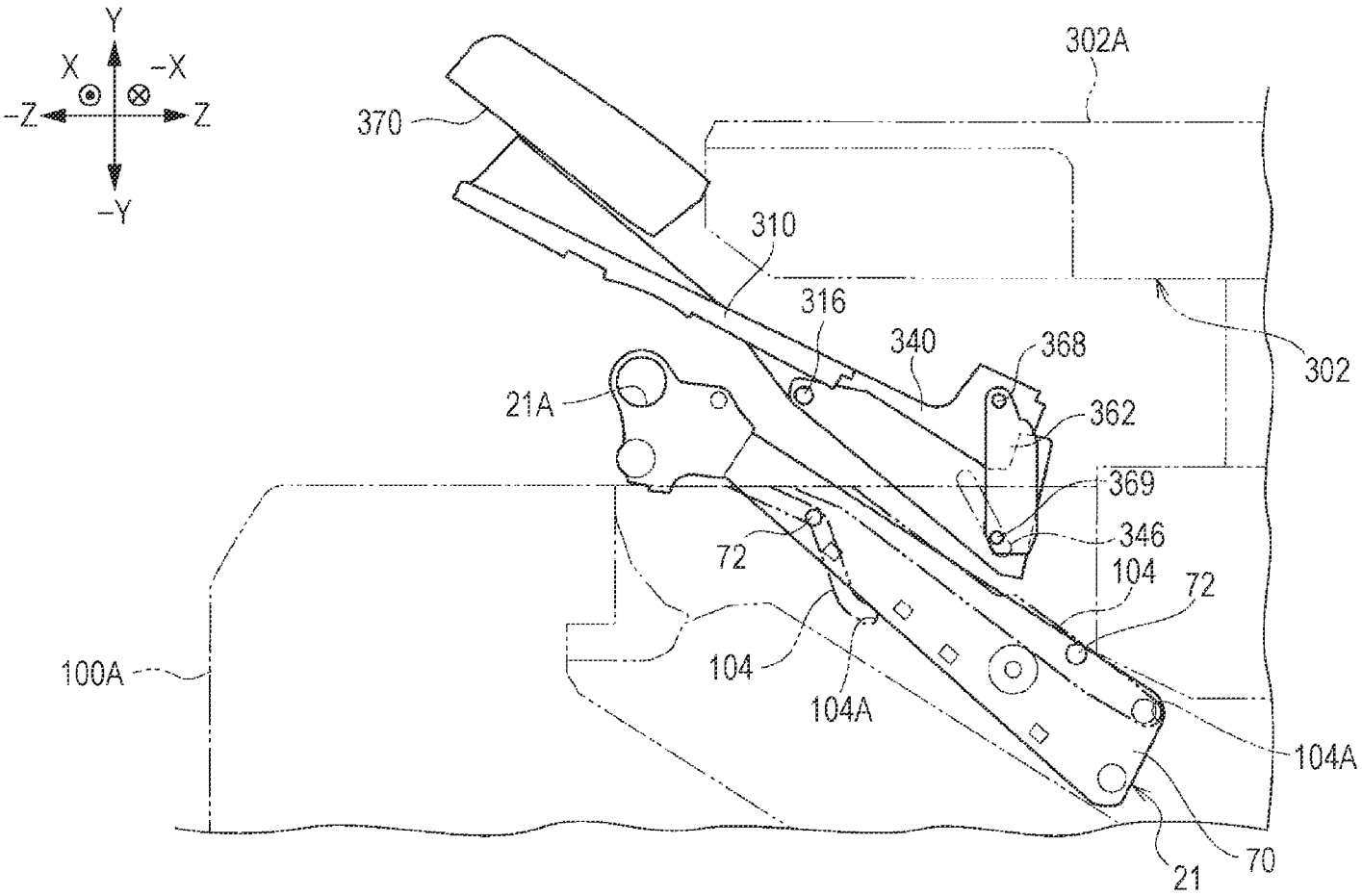
FIG. 21 is an operational view illustrating the operation in which the first transfer unit is detached.
Figure 22:
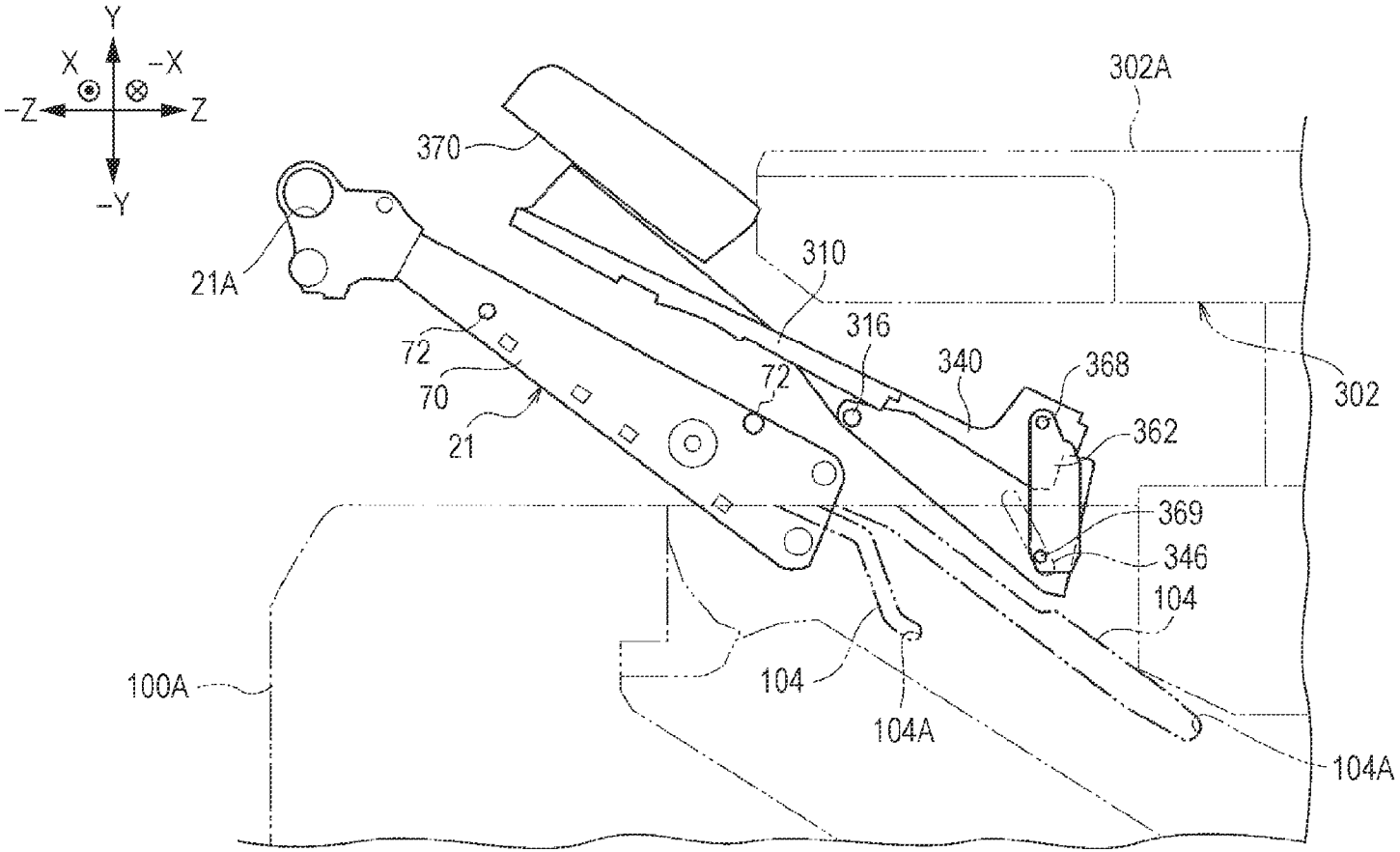
FIG. 22 is an operational view illustrating the operation in which the first transfer unit is detached.

Thus, the shaft portions 369 of the connection members 362 are positioned on an upper end sides of the long holes 346 (see FIGS. 17 and 18) when the top covering 310 is closed, and positioned on an lower end sides of the long holes 346 when the top covering 310 is opened (see FIGS. 20 to 22). Accordingly, when the top covering 310 is opened, the bottom tray 340 is moved upward along the long holes 346 while rotating about the shaft portions 316 (see FIG. 19). That is, the bottom tray 340 moves upward so as to move away from the intermediate transfer belt 32 while opening the detachment opening 105. When the top covering 310 is closed, the bottom tray 340 is moved downward along the long holes 346 while rotating about the shaft portions 316. By doing this, the bottom tray 340 together with the top covering 310 closes the detachment opening 105. Thus, the bottom tray 340 together with the top covering 310 opens and closes the detachment opening 105 in conjunction with opening and closing operations of the top covering 310.

Operation Panel 370

Figure 10:
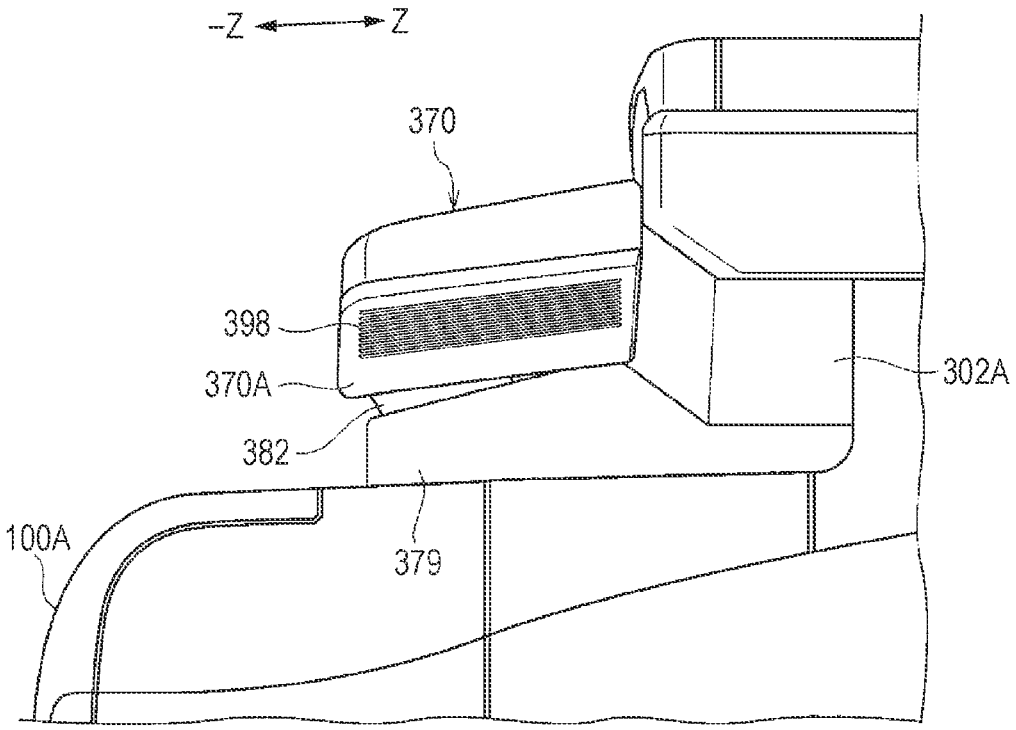
FIG. 10 is a perspective view of the configuration of an operation panel.
Figure 11:
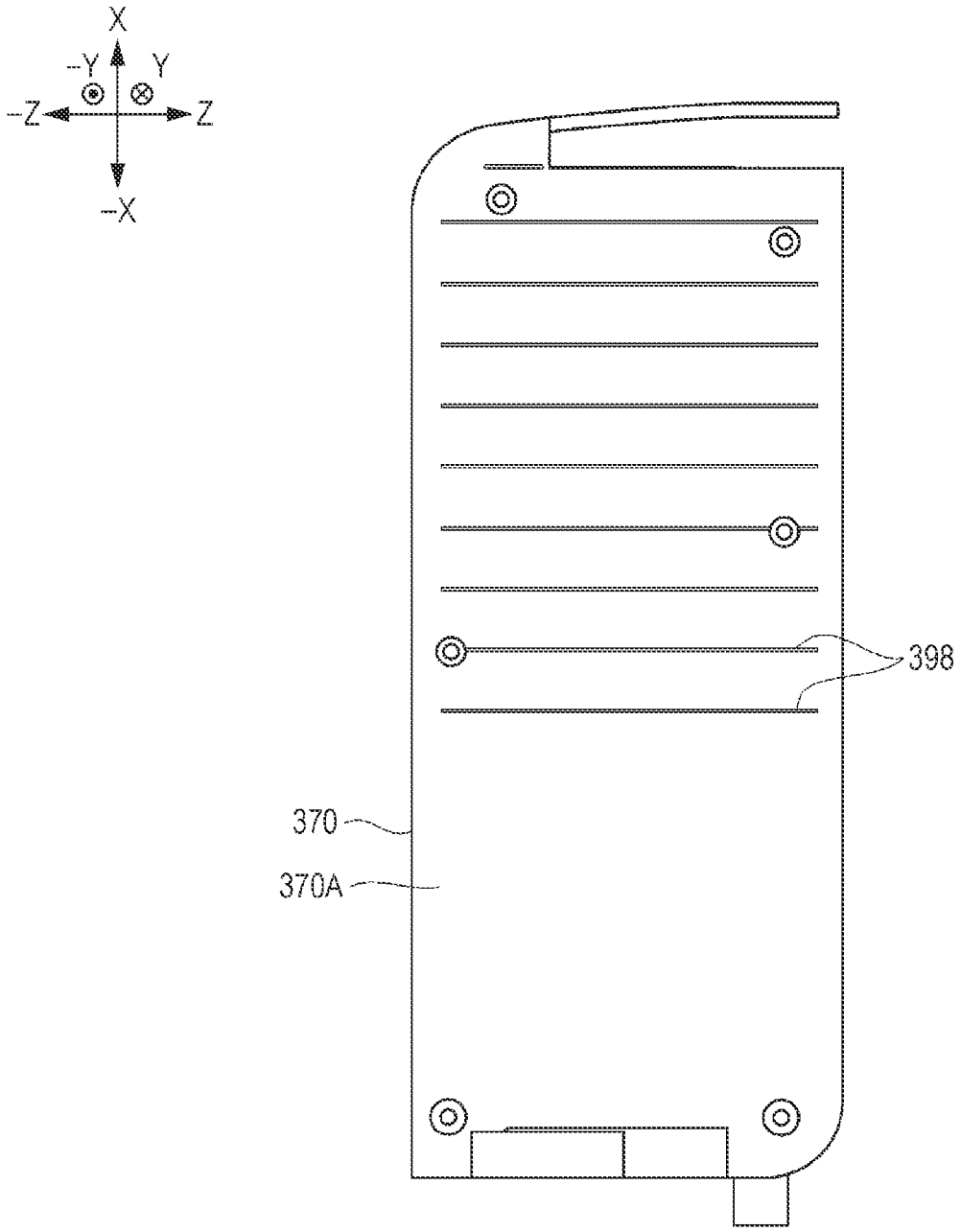
FIG. 11 is a bottom view of the configuration of the operation panel.

As illustrated in FIGS. 4 and 5, the operation panel 370 provided in the image reading device body 302A includes an operation button 370B and a display screen 370C disposed on an upper surface thereof. As illustrated in FIG. 10, in which the operation panel 370 is seen from below, plural ribs 398 are formed on a lower surface 370A (surface opposite the top covering 310) of the operation panel 370. The ribs 398 extend in the same direction as an ejection direction in which the recording medium P is ejected from the image recording device body 100A (−Z direction in bottom view). As illustrated in FIG. 11, formation of the plural ribs 398 is nonuniform on the lower surface 370A of the operation panel 370 and the plural ribs 398 are entirely formed in a portion on the X direction side (portion where the recording medium P passes) on the lower surface 370A of the operation panel 370.

Figure 17:
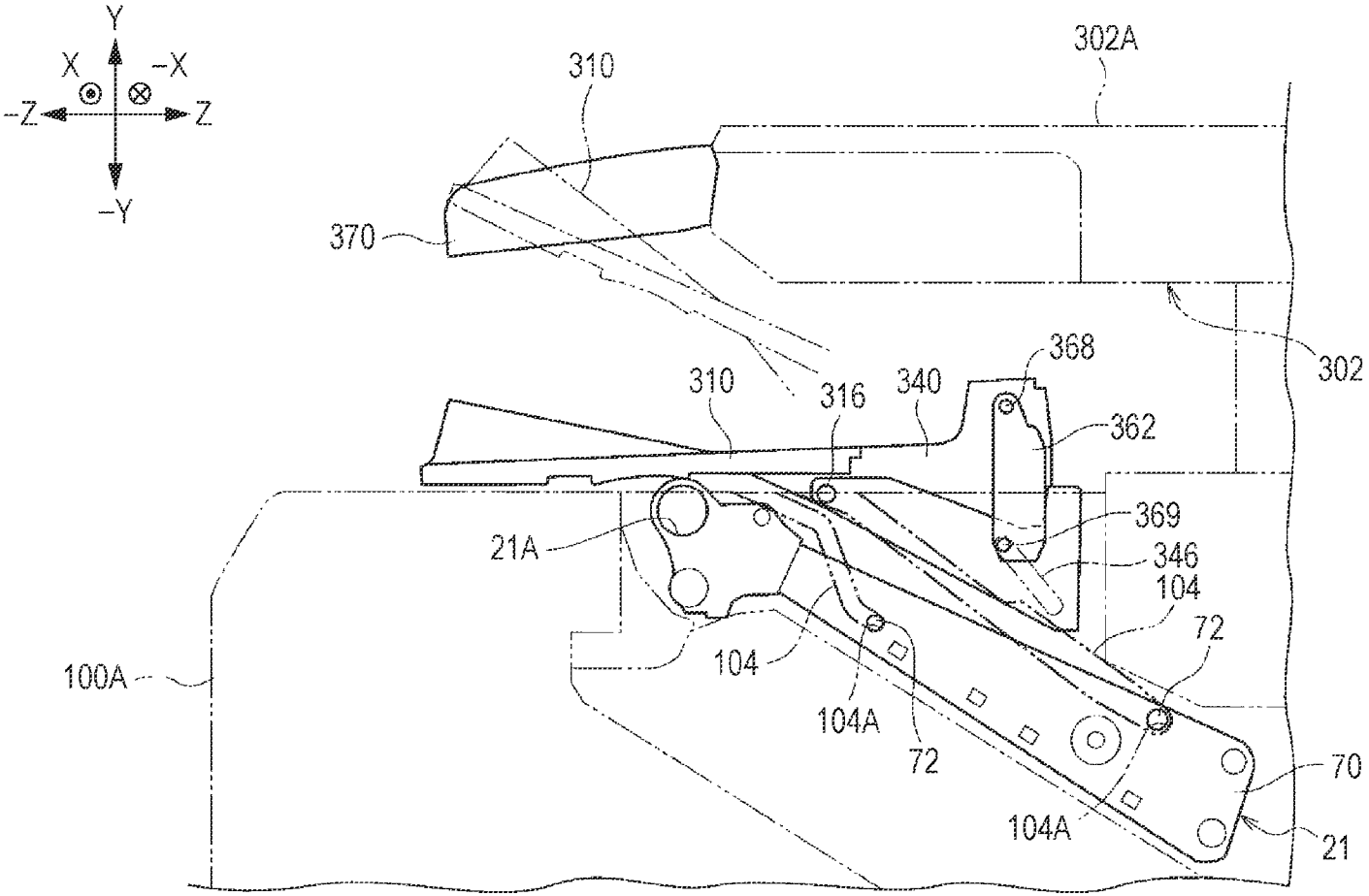
FIG. 17 is an operational view illustrating an operation in which a first transfer unit is detached.

The operation panel 370, which is provided in the image reading device body 302A, is located at a contact position at which the operation panel 370 is in contact with the top covering 310 when the top covering 310 is opened (position illustrated in FIG. 17). That is, the operation panel 370 is located on a path through which the top covering 310 passes when the top covering 310 is opening or closing. In FIG. 17, an open state of the top covering 310 is indicated by two-dot chain lines.

As illustrated in FIG. 4, the operation panel 370 is attached to the image reading device body 302A at a rotation shafts 372 (see FIG. 12) so as to be rotatable in the same direction as the rotational direction of the top covering 310. That is, like the rotation shafts 368 of the top covering 310, the rotation shafts 372 extend in the X direction.

Figure 14:
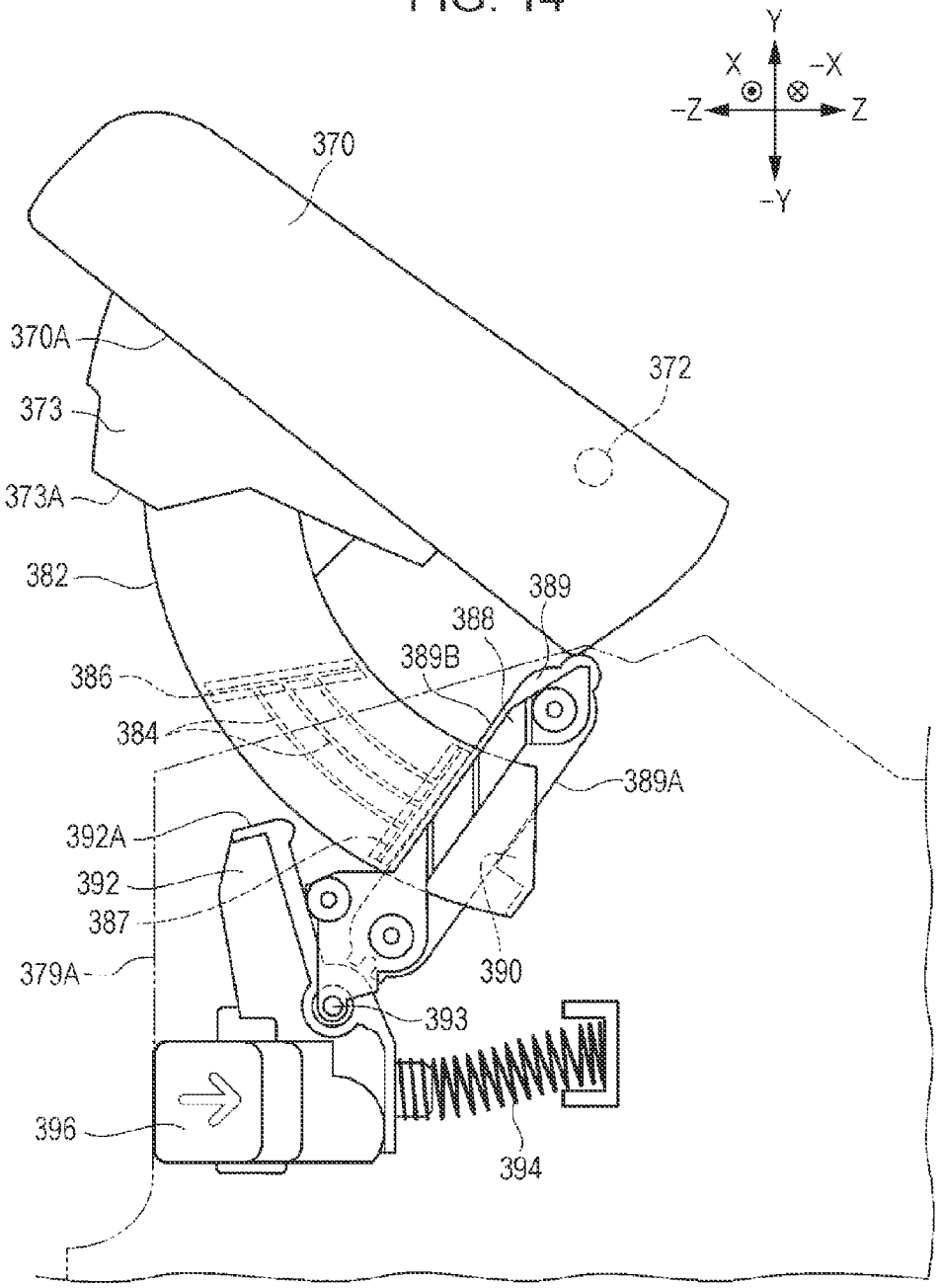
FIG. 14 is a side view of the configuration of the regulating mechanism.
Figure 15:
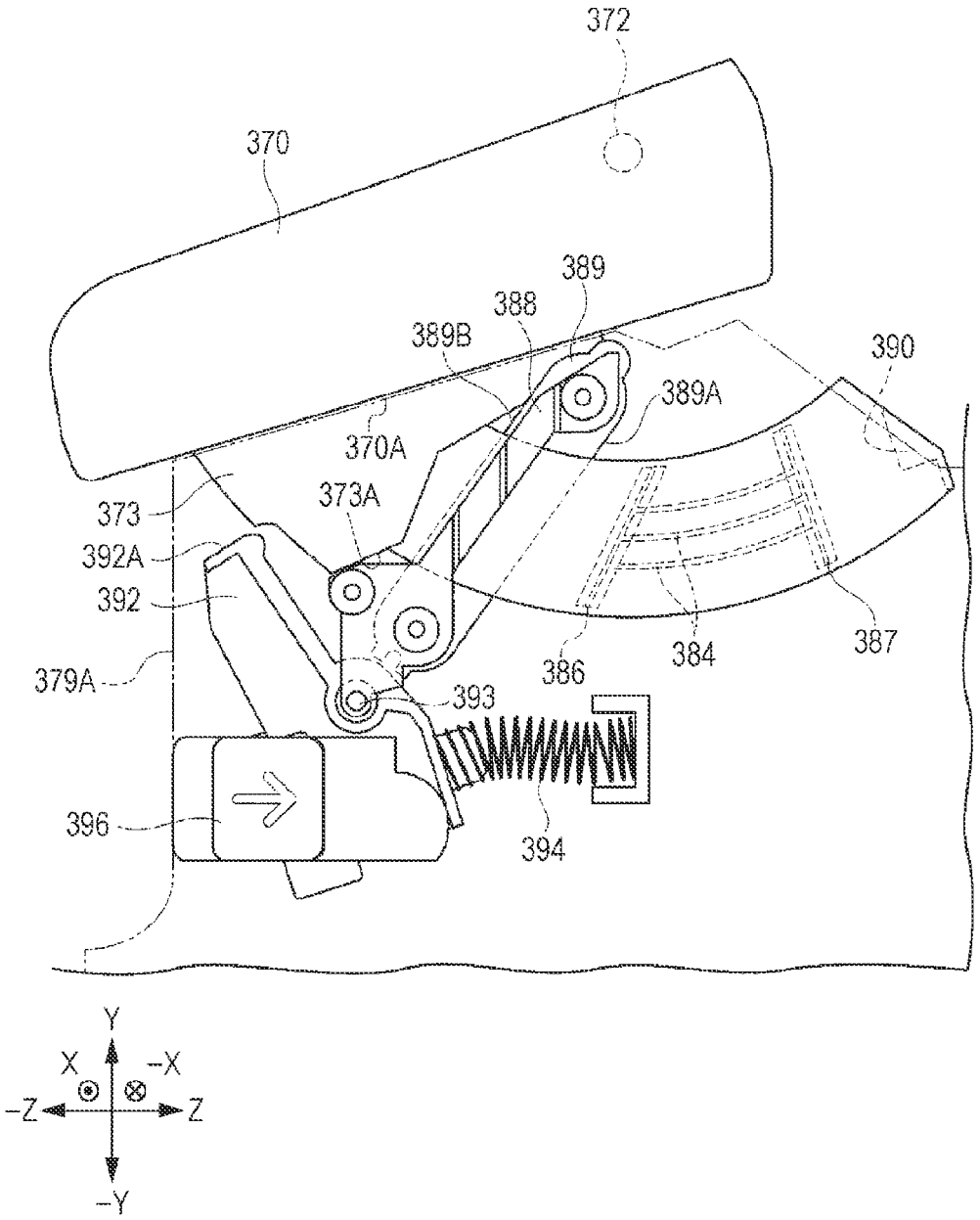
FIG. 15 is a side view of the configuration of the regulating mechanism.

With the above-described configuration, the operation panel 370 is movable among the following positions: an operation position (the above-described contact position (position illustrated in FIGS. 12, 13, and 17)) at which the operator operates the operation panel 370; a raised position (position illustrated in FIG. 14 and FIGS. 18 to 22) at which the operation panel 370 has been moved up from the operation position; and a lowered position at which the operation panel 370 has been moved down from the operation position (position illustrated in FIG. 15). In the case where the operation panel 370 is at the raised position, when the top covering 310 is opened, the operation panel 370 and the top covering 310 are brought into contact with each other.

As illustrated in FIGS. 4 and 5, a projection portion 379, which projects upward from the image recording device body 100A, is provided on the −X direction side of the operation panel 370. As illustrated in FIGS. 12 to 15, a regulating mechanism 380, which regulates rotation of the operation panel 370, is provided in the projection portion 379.

The regulating mechanism 380 has a plate member 382. The plate member 382 extends from a contact portion 373, which is formed on the lower surface 370A of the operation panel 370 and will be described later, so as to form an arc shape centered at the rotation shaft 372 in axial view with respect to the rotation shaft 372. Plural (specifically three) ribs 384 and linear ribs 386 and 387 are formed on a side surface of the plate member 382. The plural ribs 384 are curved along the arc of the plate member 382. The linear ribs 386 and 387 extend in radial directions of the arc of the plate member 382 in both end portions in the lengthwise direction of the plural ribs 384.

Figure 16:
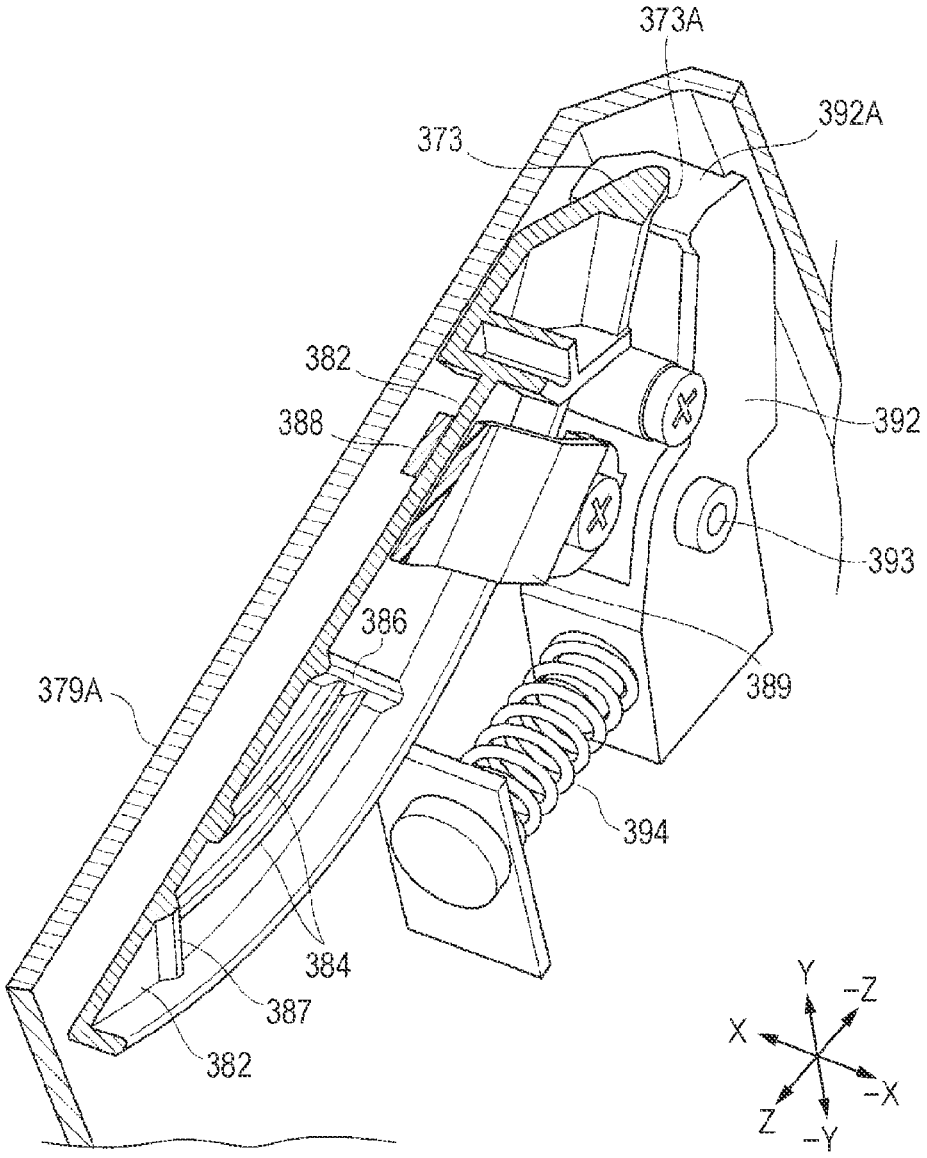
FIG. 16 is a perspective view of the configuration of the regulating mechanism.

As illustrated in FIG. 16, a plate-shaped contact member 388, which is in contact with an X direction side surface of the plate member 382, is provided on a surface on the −X direction side of a side plate 379A on the X direction side of the projection portion 379. The contact member 388 has such a length as to cross the plate member 382 in the radial direction (see FIG. 12) and is located between the side plate 379A and the plate member 382 in the X direction.

A surface on the −X direction side on the plate member 382 has a plate-shaped contact member 389, which is in contact with a −X direction side surface of the plate member 382. The contact member 389 extends so as to cross the plate member 382 in the radial direction (see FIG. 12).

Both ends of the contact member 389 in the lengthwise direction together with both ends of the contact member 388 in the lengthwise direction are secured to the side plate 379A of the projection portion 379. By doing this, the contact member 389 and the contact member 388 sandwich the plate member 382 therebetween, and the contact member 389 is in contact with the ribs 384, 386, and 387 so as to be pressed against the ribs 384, 386, and 387 at positions where the contact member 389 opposes the ribs 384, 386, and 387. The contact member 389 is formed of an elastic material such as a rubber material or a resin material. Alternatively, the contact member 388 may be omitted from the regulating mechanism 380. In this case, the contact member 389 and the side plate 379A on the X direction side of the projection portion 379 sandwich the plate member 382 therebetween.

Figure 12:
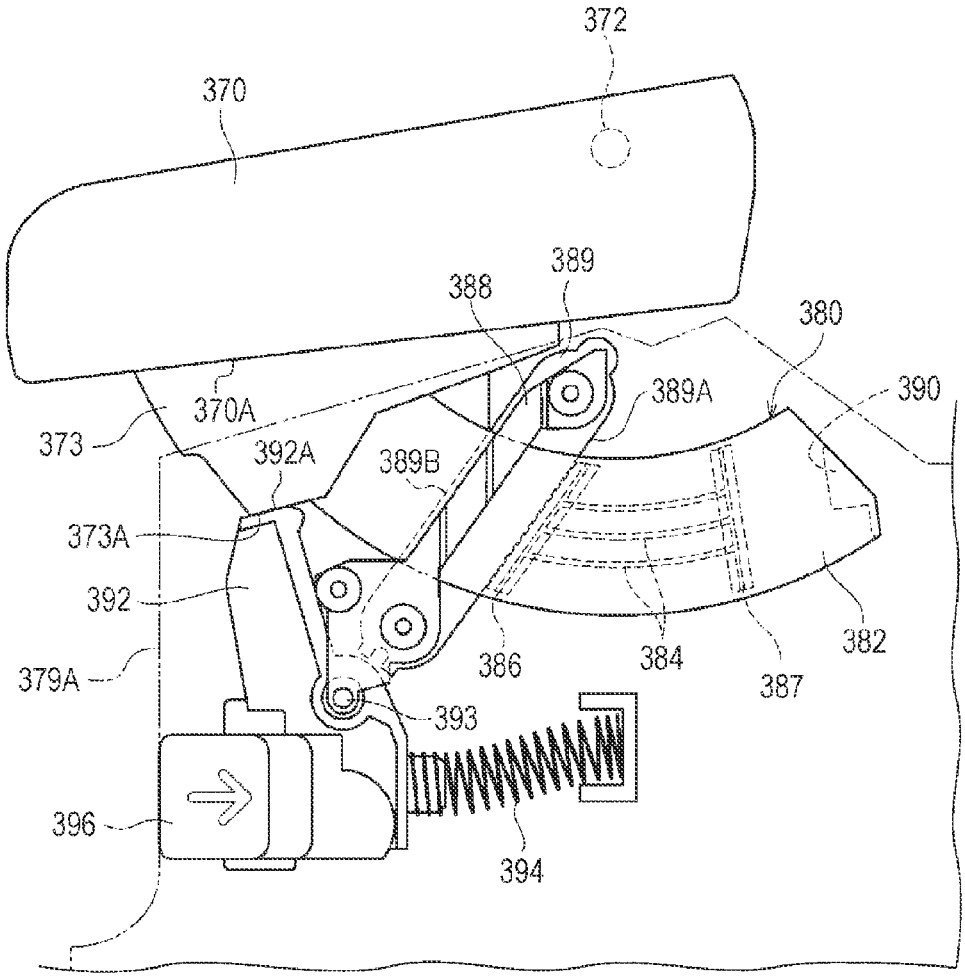
FIG. 12 is a side view of the configuration of a regulating mechanism.
Figure 12:
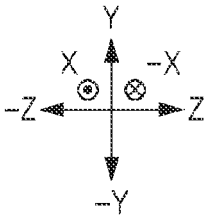
Figure 13:
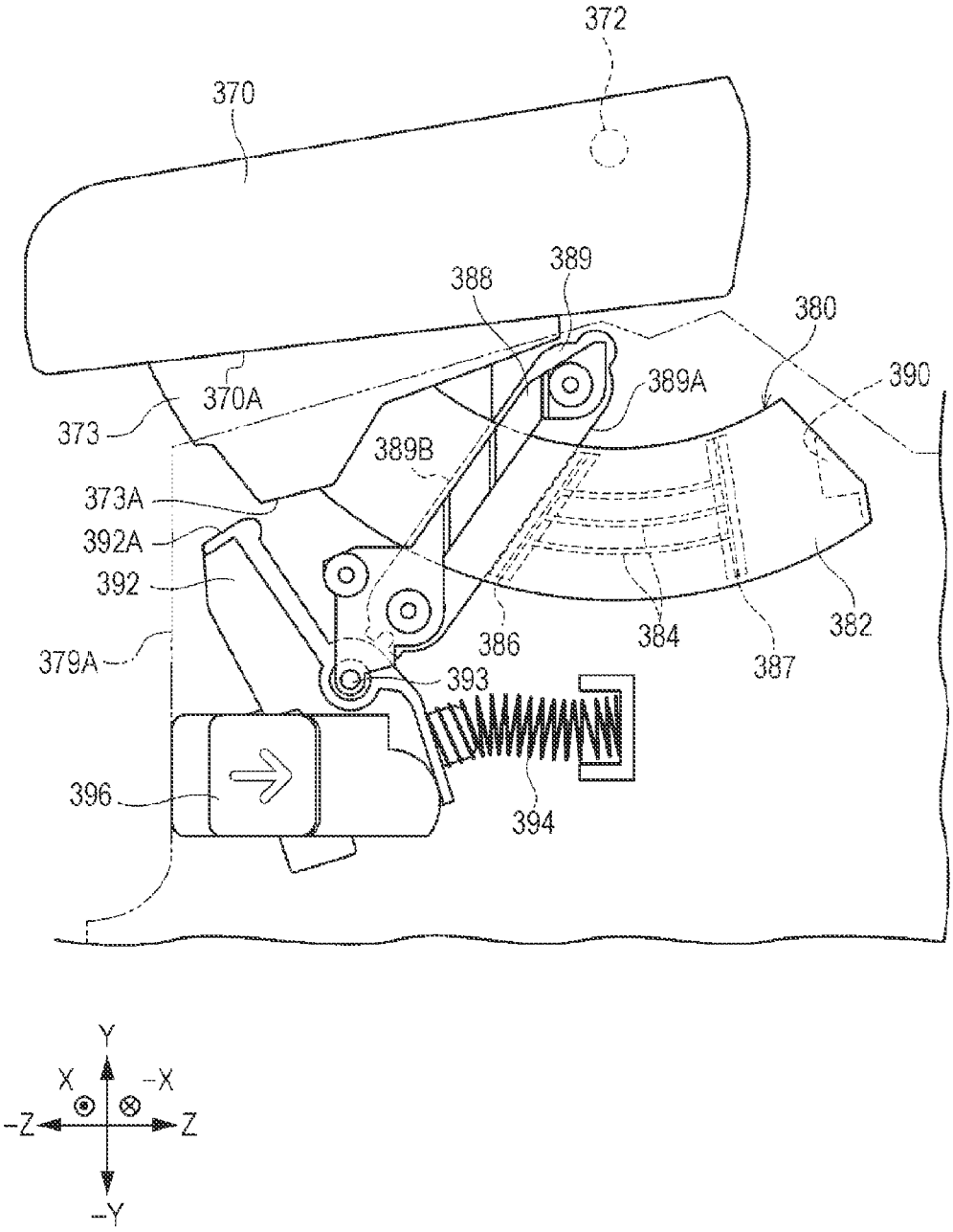
FIG. 13 is a side view of the configuration of the regulating mechanism.

In the regulating mechanism 380, as illustrated in FIGS. 12 and 13, a Z direction side edge 389A of the contact member 389 is caught by the rib 386 at the operation position of the operation panel 370. This regulates a movement of the operation panel 370 from the operation position toward the raised position. By applying a load onto the operation panel 370 in a direction from the operation position to the raised position, the load being a load equal to or greater than a predetermined load, the contact member 389 is elastically deformed. This causes the Z direction side edge 389A of the contact member 389 to slide over the rib 386, thereby allowing the operation panel 370 to move.

Also in the regulating mechanism 380, as illustrated in FIG. 14, a −Z direction side edge 389B of the contact member 389 is caught by the rib 387 at the raised position of the operation panel 370. This regulates a movement of the operation panel 370 from the raised position toward the operation position. By applying a load onto the operation panel 370 in a direction from the raised position to the operation position, the load being a load equal to or greater than a predetermined load, the contact member 389 is elastically deformed. This causes the −Z direction side edge 389B of the contact member 389 to slide over the rib 387, thereby allowing the operation panel 370 to move. At the raised position of the operation panel 370, the Z direction side edge 389A of the contact member 389 is contacted by a stopper 390 serving as a stopping member. This prevents the operation panel 370 from moving upward from the raised position. While the operation panel 370 is moving between the raised position and the operation position, the contact member 389 is in contact with the ribs 384.

While the operation panel 370 is moving between the operation position and the lowered position, the contact member 389 is not in contact with the ribs 384, 386, and 387, and transfer resistances of the ribs 384, 386, and 387 are not produced.

In the regulating mechanism 380, when the operation panel 370 is at the lowered position, as illustrated in FIG. 15, the lower surface 370A of the operation panel 370 is contacted by the X direction side side plate 379A of the projection portion 379. This prevents the operation panel 370 from further moving downward from the lowered position.

Furthermore, as illustrated in FIGS. 12 and 13, a stopper 392 is provided on the X direction side side plate 379A of the projection portion 379. The stopper 392 serves as an example of a stopping device that prevents the operation panel 370 at the operation position of the operation panel 370 from rotating in a lowering direction (the same direction as a direction in which the top covering 310 is closing).

The contact portion 373, which is in contact with an upper surface 392A (stopping surface) of the stopper 392, is provided on the lower surface 370A of the operation panel 370. The stopper 392 is supported by the side plate 379A, which is formed on the X direction side of the projection portion 379, such that the stopper 392 is rotatable about a rotation shaft 393 between a contact position and an away position. The stopper 392 is in contact with a lower surface (stopped surface) 373A of the contact portion 373 at the contact position (see FIG. 12) and moves away from the lower surface (stopped surface) 373A of the contact portion 373 to the away position (see FIG. 13).

A coil spring 394 serving as an urging member is attached to the X direction side side plate 379A of the projection portion 379. The coil spring 394 urges the stopper 392 toward the contact position. Furthermore, a release operation unit 396 serving as an example of a releasing device is provided in the X direction side side surface 379A of the projection portion 379. The release operation unit 396 releases a state in which the stopper 392 prevents the operation panel 370 from rotating. When the release operation unit 396 is pushed by the operator, the stopper is moved to the away position against the urging force of the coil spring 394. When the operation panel 370 is moved in a raising direction (the same direction as a direction in which the top covering 310 is opened), that is, when the operation panel 370 is moved from the lowered position to the operation position or moved from the operation position to the raised position, the stopper 392 does not function and allows these movements of the operation panel 370.

Operation of Operation Panel 370

The stopper 392 prevents the operation panel 370 at the operation position, at which the operator operates the operation panel 370, from rotating toward the lowered position. Thus, rotation of the operation panel 370 toward the lowered position is suppressed when an input operation, which is performed when the operation button 370B is pressed.

The stopper 392 does not prevent the operation panel 370 at the operation position, at which the operator operates the operation panel 370, from rotating toward the raised position and allows the operation panel 370 to rotate toward the raised position. Thus, when the top covering 310 is opened, the operation panel 370 together with the top covering 310 is pushed up. This suppresses regulation of opening of the top covering 310 with the operation panel 370.

When the release operation unit 396 is operated by the operator, a state in which the stopper 392 prevents the operation panel 370 from rotating from the operation position toward the lowered position is released. This allows the operation panel 370 to rotate in the lowering direction. The operation panel 370 is moved to the lowered position when the operation panel 370 is pressed down in the lowering direction by the operator. By moving the operation panel 370 to the lowered position, the angle of the display screen 370C of the operation panel 370 is adjusted so that the display screen 370C is visible and operable for an operator having a small build, and operation and maintenance check for the image reading device 302 is facilitated.

Since the ribs 398 are formed on the lower surface 370A of the operation panel 370, transfer resistances are unlikely to act on the recording medium P even when the recording medium P having been ejected from the image recording device body 100A to the output unit 48 contacts the lower surface 370A of the operation panel 370 while the operation panel 370 is positioned at the operation position or the lowered position.

In order to open the top covering 310, the operation panel 370 is rotated from the operation position or the lowered position to the raised position by the operator. By doing this, a space in which the top covering 310 to be opened is rotatably movable is increased. Thus, compared to the case where the top covering 310 is opened while the operation panel 370 is positioned at the operation position or the lowered position, the top covering 310 does not interfere with the operation panel 370 and is more widely opened.

Attachment and Detachment of First Transfer Unit 21

Next, attachment and detachment operations of the first transfer unit 21 are described.

Figure 18:
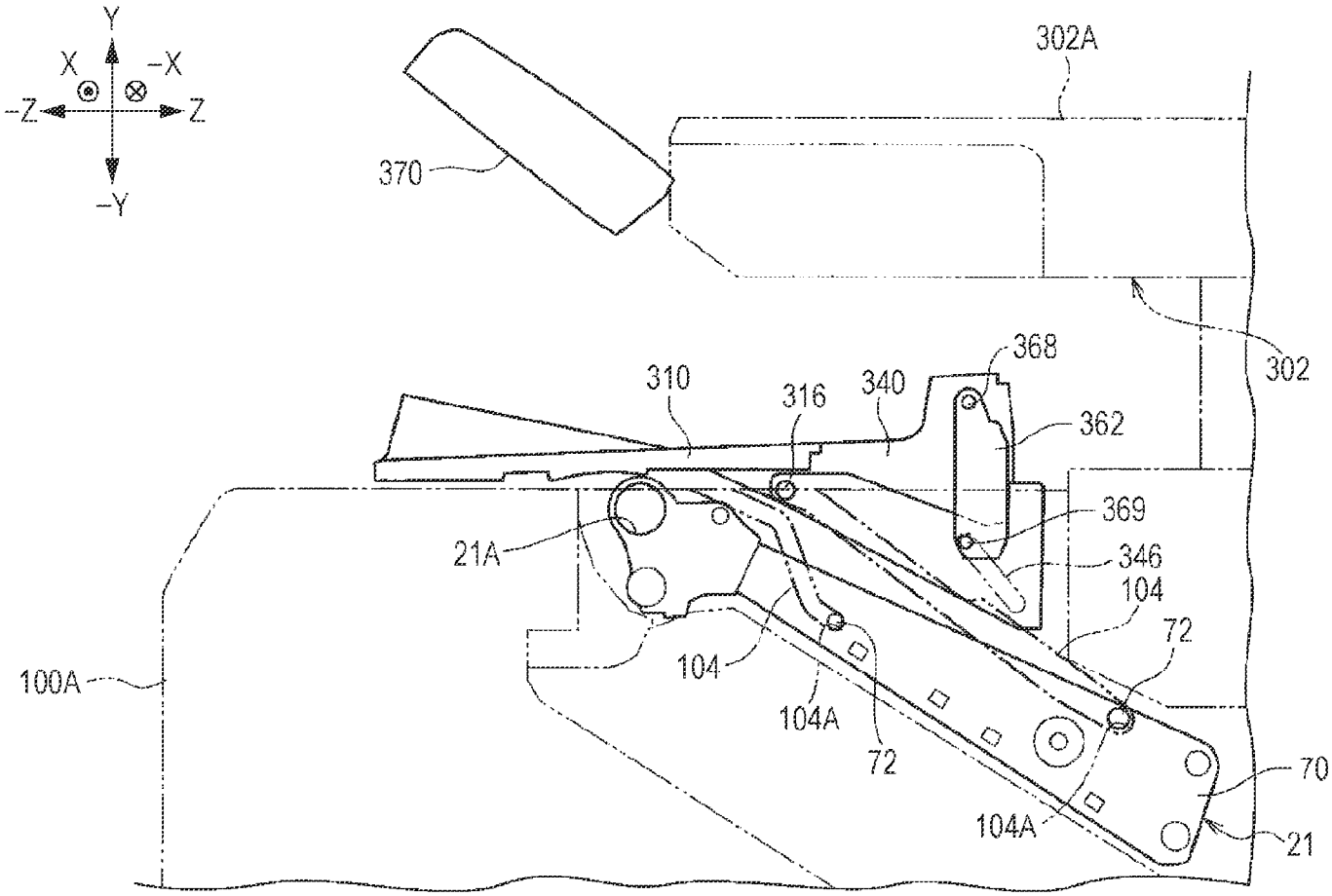
FIG. 18 is an operational view illustrating the operation in which the first transfer unit is detached.

In order to detach the first transfer unit 21 from the image recording device body 100A, as illustrated in FIGS. 17 and 18, the operation panel 370 is initially moved from the operation position (position illustrated in FIG. 17) to the raised position (position illustrated in FIG. 18) by the operator.

Figure 19:
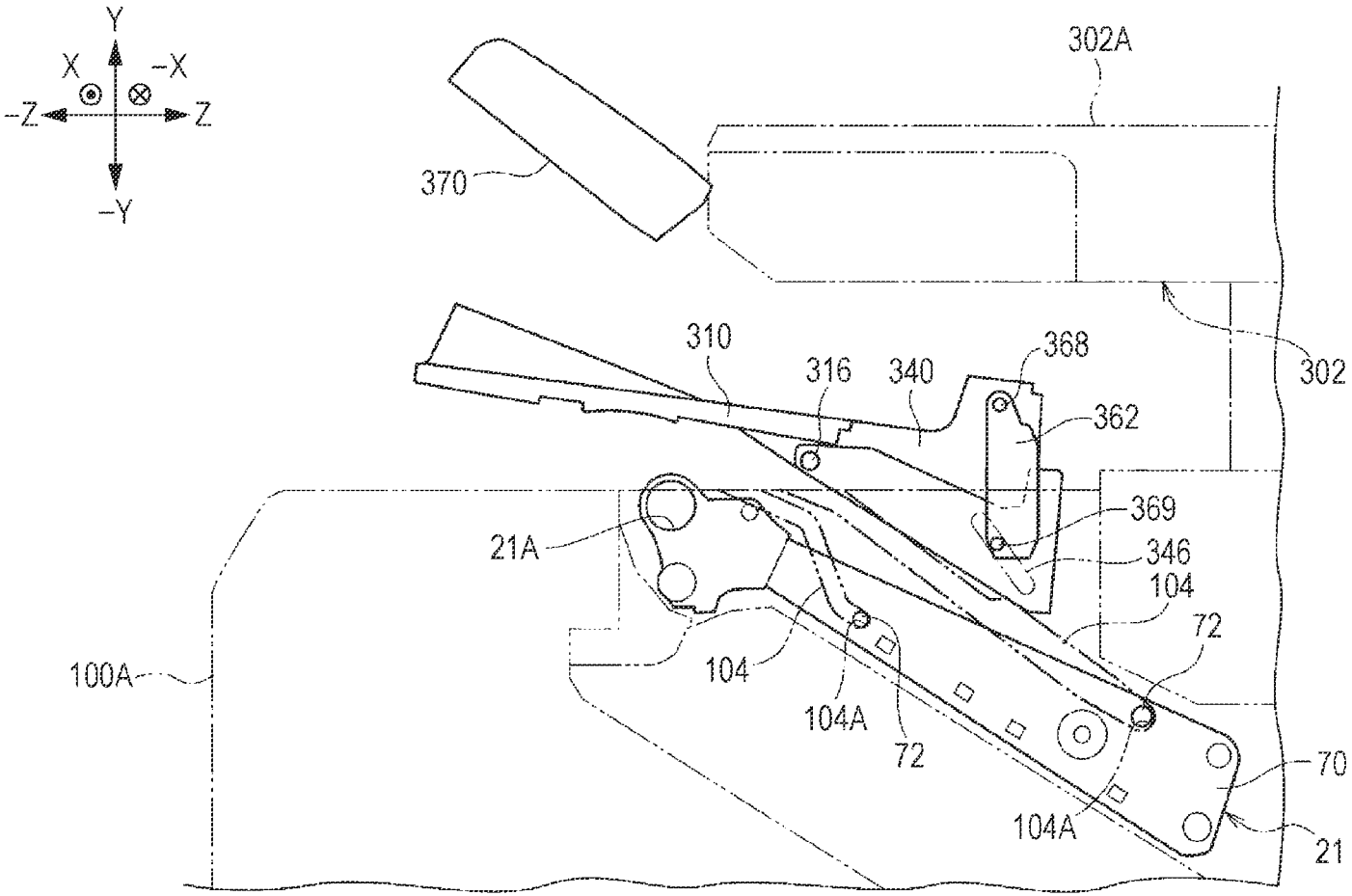
FIG. 19 is an operational view illustrating the operation in which the first transfer unit is detached.

Next, as illustrated in FIG. 19, the top covering 310 is moved from the closed position (position illustrated in FIG. 18) toward the open position (position illustrated in FIG. 19) by the operator. As the top covering 310 is opening, the bottom tray 340 swings (rotates) about the shaft portions 316 and moves upward while the shaft portions 369 of the connection members 362 relatively move toward a diagonally downward position through the long holes 346.

Thus, in the present exemplary embodiment, the bottom tray 340 moves upward along with the opening operation of the top covering 310 and moves away from the intermediate transfer belt 32 (first transfer unit 21). This suppresses interference of the bottom tray 340 with the intermediate transfer belt 32 (first transfer unit 21) when the top covering 310 is opened or closed.

When the top covering 310 has been moved to the open position as illustrated in FIG. 20 by the operator, the top covering 310 is brought into contact with the lower surface 370A of the operation panel 370. Thus, a movement of the top covering 310 to the operation position is completed.

Next, the regulating roller 82 and the first transfer rollers 34Y, 34M, 34C, and 34K are separated from the intermediate transfer belt 32 by the operator so as to separate the intermediate transfer belt 32 from the image carrying bodies 18 (see FIG. 2).

Next, the grip portions 21A of the first transfer unit 21 are held and the first transfer unit 21 is moved toward a diagonally upper left position in FIG. 21 from the image recording device body 100A as illustrated in FIG. 21 by the operator. The protrusions 72 of the first transfer unit 21 are guided by the guide grooves 104 so as to move the first transfer unit 21 toward a diagonally upper left position in FIG. 21. When the first transfer unit 21 is further moved up by the operator as illustrated in FIG. 22, the first transfer unit 21 is detached from the image recording device body 100A.

In order to attach the first transfer unit 21 to the image recording device body 100A, the first transfer unit 21 is attached to a diagonally lower right position in FIG. 22 of the image recording device body 100A by the operator through the detachment opening 105 of the image recording device body 100A.

In the present exemplary embodiment, when the first transfer unit 21 is moved into or out of the image recording device body 100A, the bottom tray 340 is moved upward and the detachment opening 105 is widely opened. This suppresses interference of the first transfer unit 21 with the bottom tray 340.

Modification

In the present exemplary embodiment, when the top covering 310 is opened, the operation panel 370 is located at the contact position (position illustrated in FIG. 17), at which the operation panel 370 is in contact with the top covering 310, and rotates in the same direction as a direction in which the top covering 310 rotates. However, the operation panel 370 does not necessarily rotate. In a configuration in which the operation panel 370 does not rotate, the operation panel 370 is located, for example, at an upper position where the operation panel 370 is spaced apart from the top covering 310 such that the operation panel 370 is not in contact with the top covering 310 when the top covering 310 is opened.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an apparatus body comprising an upper portion and an opening:

an image carrying body provided in the apparatus body, the image carrying body being configured to carry an image;

a transfer body provided in the apparatus body, the transfer body being configured to transfer the image carried by the image carrying body;

a first opening and closing member having a first rotational axis portion, the first opening and closing member being attached to the upper portion of the apparatus body so as to be rotatable about the first rotational axis portion so as to open and close the opening, the transfer body being detachable from the apparatus body through the opening;

a second opening and closing member provided on the first rotational axis portion side of the first opening and closing member so as to be displaceable relative to the first opening and closing member, the second opening and closing member being located such that, if the second opening and closing member were to rotate together with the first opening and closing member about a rotational axis of the first rotational axis portion to thereby open the opening, then the second opening and closing member would interfere with the transfer body, and the second opening and closing member being configured to, together with the first opening and closing member, open and close the opening in conjunction with opening and closing operations of the first opening and closing member; and a movement mechanism configured to cause the second opening and closing member to move in a direction away from the transfer body in conjunction with the opening operation of the first opening and closing member.

2. The image forming apparatus according to claim 1, wherein the movement mechanism comprises a connection member that connects the first opening and closing member and the second opening and closing member to each other.

3. The image forming apparatus according to claim 2, wherein the second opening and closing member comprises a first connection portion that connects the second opening and closing member to the first opening and closing member, and wherein the first connection portion is configured to allow the second opening and closing member, together with the first opening and closing member, to open and close the opening in conjunction with the opening and closing operations of the first opening and closing member.

4. The image forming apparatus according to claim 3, wherein the first opening and closing member comprises a second connection portion that connects the first opening and closing member to the connecting member, and the second connection portion serves as the first rotational axis portion, wherein the connection member comprises a third connection portion and a guided portion, the third connection portion connects the connection member to the second opening and closing member, the second opening and closing member comprises a guiding portion, and the third connection portion serves as the guided portion to be guided by the guiding portion, and wherein the movement mechanism is configured to cause the second opening and closing member to move in a direction away from the transfer body in conjunction with the opening operation of the first opening and closing member due to guidance of the guided portion using the guiding portion.

5. The image forming apparatus according to claim 4, wherein the second opening and closing member comprises a second rotational axis portion, the first connection portion serves as the second rotational axis portion, and the second opening and closing member is configured to rotate about a rotational axis of the second rotational axis portion in conjunction with the opening and closing operations of the first opening and closing member so as to open and close the opening together with the first opening and closing member.

6. The image forming apparatus according to claim 5, wherein the first opening and closing member comprises one end portion and another end portion, the first opening and closing member having the first rotational axis portion at the one end portion, wherein the second opening and closing member comprises one end portion and another end portion, the one end portion of the second opening and closing member is connected to the first opening and closing member at a position of the first opening and closing member closer to the another end portion of the first opening and closing member than the first rotational axis portion is, the second opening and closing member comprises the second rotational axis portion in the one end portion of the second opening and closing member, and the second opening and closing member is connected to the connection member at a position of the second opening and closing member closer to the another end portion of the second opening and closing member than the second rotational axis portion is, and wherein the movement mechanism is configured to cause the second opening and closing member to move in the direction away from the transfer body in conjunction with the opening operation of the first opening and closing member due to guidance of the guided portion using the guiding portion.

7. The image forming apparatus according to claim 3, wherein the second opening and closing member comprises a second rotational axis portion, the first connection portion serves as the second rotational axis portion, and the second opening and closing member is configured to rotate about a rotational axis of the second rotational axis portion in conjunction with the opening and closing operations of the first opening and closing member so as to open and close the opening together with the first opening and closing member.

8. The image forming apparatus according to claim 2, wherein the first opening and closing member comprises a first connection portion that connects the first opening and closing member to the connecting member, and the first connection portion serves as the first rotational axis portion, wherein the connection member comprises a second connection portion and a guided portion, the second connection portion connects the connection member to the second opening and closing member, the second opening and closing member comprises a guiding portion, and the second connection portion serves as the guided portion to be guided by the guiding portion, and wherein the movement mechanism is configured to cause the second opening and closing member to move in a direction away from the transfer body in conjunction with the opening operation of the first opening and closing member due to guidance of the guided portion using the guiding portion.

9. The image forming apparatus according to claim 1, wherein the second opening and closing member comprises a first connection portion that connects the second opening and closing member to the first opening and closing member, and wherein the first connection portion is configured to allow the second opening and closing member, together with the first opening and closing member, to open and close the opening in conjunction with the opening and closing operations of the first opening and closing member.

10. The image forming apparatus according to claim 9, wherein the second opening and closing member comprises a second rotational axis portion, the first connection portion serves as the second rotational axis portion, and the second opening and closing member is configured to rotate about a rotational axis of the second rotational axis portion in conjunction with the opening and closing operations of the first opening and closing member so as to open and close the opening together with the first opening and closing member.

11. The image forming apparatus according to claim 9, wherein the first connection portion comprises circular insertion holes, wherein the first opening and closing member comprises shaft portions, each one of the shaft portions being rotatably inserted into a corresponding one of the circular insertion holes.

12. The image forming apparatus according to claim 1, wherein, when the first opening and closing member and the second opening and closing member are closed, the first opening and closing member and the second opening and closing member form an output unit that receives a recording medium ejected from the apparatus body.

* * * * *